US006274301B1

(12) United States Patent
Okamura et al.

(10) Patent No.: US 6,274,301 B1
(45) Date of Patent: Aug. 14, 2001

(54) PHOTOTHERMOGRAPHIC RECORDING ELEMENTS

(75) Inventors: Hisashi Okamura; Hirohiko Tsuzuki; Itsuo Fujiwara; Yoshiharu Yabuki, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/174,011

(22) Filed: Oct. 16, 1998

Related U.S. Application Data

(63) Continuation of application No. PCT/JP98/00392, filed on Jan. 30, 1998.

(30) Foreign Application Priority Data

Feb. 17, 1997 (JP) ..... 9-048426
Mar. 27, 1997 (JP) ..... 9-093226

(51) Int. Cl.[7] ..... G03C 1/498; G03C 1/83

(52) U.S. Cl. ..... 430/619; 517/519; 517/521; 517/607; 517/619

(58) Field of Search ..... 430/619, 517, 430/617, 607, 531, 521, 519, 138

(56) References Cited

U.S. PATENT DOCUMENTS

| | | | | |
|---|---|---|---|---|
| 4,102,312 | | 7/1978 | Sashihara et al. . | |
| 4,259,424 | | 3/1981 | Endo et al. . | |
| 4,477,562 | | 10/1984 | Zeller-Pendrey . | |
| 5,252,423 | * | 10/1993 | Kakimi et al. | 430/138 |
| 5,258,282 | | 11/1993 | Kagami et al. . | |
| 5,493,327 | | 2/1996 | McCallum et al. . | |
| 5,656,419 | * | 8/1997 | Toya et al. | 430/619 |
| 5,783,380 | * | 7/1998 | Smith et al. | 430/619 |

FOREIGN PATENT DOCUMENTS

| | | |
|---|---|---|
| 1261102 | 1/1972 | (EP) . |
| 0600587A1 | 6/1994 | (EP) . |
| 0796742A | 9/1997 | (EP) . |
| 0805376A | 11/1997 | (EP) . |
| 720598 | 1/1924 | (JP) . |
| 4-343355 | 11/1992 | (JP) . |
| 4358144 | 12/1992 | (JP) . |
| 5-45831 | 2/1993 | (JP) . |
| 553239 | 3/1993 | (JP) . |
| 6-35133 | 2/1994 | (JP) . |
| 6-138622 | 5/1994 | (JP) . |
| 6-202268 | 7/1994 | (JP) . |

OTHER PUBLICATIONS

Hackh's Chemical Dictionary, pp. 399, 817, 1972.*
The Condensed Chemical Dictionary, pp. 601–602, 1981.*

* cited by examiner

*Primary Examiner*—Thorl Chea
(74) *Attorney, Agent, or Firm*—Birch, Stewart, Kolasch & Birch, LLP

(57) ABSTRACT

A photothermographic recording element having improved image tone and improved tone stability during storage is provided wherein at least one of constituent layers comprises (a) polymeric microparticulates containing a dyestuff, (b) microcapsules containing a dyestuff, and/or (c) an organic or inorganic pigment.

9 Claims, No Drawings

PHOTOTHERMOGRAPHIC RECORDING ELEMENTS

This application is a Continuation of PCT application no. PCT/JP98/00392 filed on Jan. 30, 1998, which designated the United States and on which priority is claimed under 35 U.S.C. §120, the entire contents of which are hereby incorporated by reference.

TECHNICAL FIELD

This invention relates to a photothermographic recording element and more particularly, to a photothermographic element having improved tone stability during storage.

BACKGROUND ART

Photothermographic materials which are processed by a thermographic process to form photographic images are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

These photothermographic materials generally contain a reducible silver source (e.g., organic silver salt), a catalytic amount of a photocatalyst (e.g., silver halide), a toner for controlling the tone of silver, and a reducing agent, typically dispersed in an organic binder matrix. Photothermographic materials are stable at room temperature. When they are heated at an elevated temperature (e.g., 80° C. or higher) after exposure, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, forming an image.

Recently in the medical field, the imaging technology has made an advance with a focus on the keyword of easy, rapid and Earth-friendly processing. For example, the development of a medical image recording system which is laser exposed and heat developed started, and a dry system discharging a processing solution as little as possible has become widespread. Meanwhile, the laser output means has also made a progress to offer a wider range of choice of lasers, and the demand for visible light lasers is increasing.

For such photographic photosensitive materials, there are known in the art various methods of containing dyestuffs in the photosensitive materials to adjust the tone thereof in order that an image as a whole look in a more black tone, for example, a method of using oil-soluble dyestuffs in photographic silver halide photosensitive materials as described in JP-A 243654/1985, a method of using an emulsified dispersion of specific anthraquinone dyestuffs as described in JP-A 139607/1989, and a method of emulsifying and dispersing a colored dyestuff together with a polymer and introducing the dispersion into an emulsion layer as described in JP-A 289227/1993 and 341441/1993.

However, when dyestuffs are contained in emulsion layers of photothermographic materials by such prior art methods, the dyestuffs can adversely affect photographic properties by increasing the fog by development and reducing the sensitivity beyond the necessity.

Moreover, due to the co-presence of polyhalogenated compounds important as antifoggants for heat development, the dyestuffs can be bleached during storage whereby the image tone is deteriorated or discoloration occurs.

DISCLOSURE OF THE INVENTION

Therefore, an object of the invention is to provide a photothermographic recording element featuring an improved image tone and improved tone stability during storage.

Making extensive investigations, we have completed the invention that achieves the above object.

(1) A photothermographic recording element comprising a transparent support, a binder, a non-photosensitive organic silver salt, a photosensitive silver halide, and a reducing agent, characterized in that at least one of constituent layers comprises (a) polymeric microparticulates containing a dyestuff, (b) microcapsules containing a dyestuff, and/or (c) an organic or inorganic pigment.

(2) The photothermographic recording element of (1) wherein at least one of constituent layers comprises a toner.

(3) The photothermographic recording element of (1) wherein at least one of constituent layers comprises a polyhalogenated compound.

(4) The photothermographic recording element of (1) comprising as a constituent layer on the transparent support a photosensitive layer containing a photosensitive silver halide and a binder wherein at least one layer of the photo-sensitive layer comprises (a) polymeric microparticulates containing a dyestuff, (b) microcapsules containing a dyestuff, and/or (c) an organic or inorganic pigment, and a polyhalogenated compound.

(5) The photothermographic recording element of (1) wherein (i) polymeric microparticulates containing a dyestuff having at least one absorption peak in the range of 500 to 700 nm, (ii) microcapsules containing a dyestuff having at least one absorption peak in the range of 500 to 700 nm, and/or (iii) an organic or inorganic pigment having at least one absorption peak in the range of 500 to 700 nm is contained.

(6) The photothermographic recording element of (1) wherein an aqueous latex is used as the binder.

BEST MODE FOR CARRYING OUT THE INVENTION

Now the invention is described in detail.

The photothermographic recording element of the invention comprises on a support constituent layers at least one of which comprises (a) polymeric microparticulates containing a dyestuff, (b) microcapsules containing a dyestuff, and/or (c) an organic or inorganic pigment.

By adding a dyestuff in the form contained in polymeric microparticulates or microcapsules or a pigment to a photosensitive element, the element is improved in image tone, and also improved in light fastness in that the discoloration or fading of the image tone by light illumination is eliminated. There is no detrimental influence on photographic properties.

These advantages are enhanced when at least one of the constituent layers contains a polyhalogenated compound as an antifoggant, especially when at least one photosensitive layer containing a photosensitive silver halide, among the constituent layers, comprises (a) polymeric microparticulates containing a dyestuff, (b) microcapsules containing a dyestuff or (c) an organic or inorganic pigment.

In contrast, if a dyestuff is added as such, the light stability of the image tone is insufficient, and especially in the co-presence of polyhalogenated compounds, substantial discoloration or fading occurs as a result of bleaching of the dyestuff by light illumination.

The dyestuff used in the photosensitive recording element of the invention may be any desired one and selected from, for example, pyrazoloazole, anthraquinone, azo, azomethine, oxonol, carbocyanine, styryl, triphenylmethane, indoaniline, indophenol, and squarylium dyestuffs. Preferred of the dyestuffs used herein are anthraquinone dyestuffs (for example, Compounds 1 to 9 in JP-A 341441/1993, Compounds 3–6 to 3–18 and 3–23 to 3–38 in JP-A 165147/1993), azomethine dyestuffs (for example, Compounds 17 to 47 in JP-A 341441/1993), indoaniline dyestuffs (for example, Compounds 11 to 19 in JP-A 289227/1993, Compound 47 in JP-A 341441/1993 and Compounds 2–10 to 2–11 in JP-A 165147/1993), and azo dyestuffs (for example, Compounds 10 to 16 in JP-A 341441/1993). The amount of these dyestuffs used is determined by the desired quantity of absorption and in general, it is preferred to use the dyestuffs in amounts of 1 $\mu$g to 1 g per square meter of the photosensitive recording element.

Preferably, the dyestuff used herein exhibits a maximum absorption of 0.1 to 2 in the desired range of wavelength.

The dyestuff used herein may have a function of anti-halation or irradiation prevention, and a layer containing the dyestuff may be an anti-halation layer or irradiation-preventing layer.

Where the dyestuff is used herein for the purpose of anti-halation or irradiation prevention, the dyestuff may be any compound as long as it has the desired absorption in the wavelength range and provides an anti-halation layer or irradiation preventing layer with a preferred profile of absorbance spectra. The following compounds are disclosed although the invention is not limited thereto. The dyestuffs used alone include the compounds described in JP-A 56458/1984, 216140/1990, 13295/1995, 11432/1995, U.S. Pat. No. 5,380,635, JP-A 68539/1990, page 13, lower-left column, line 1 to page 14, lower-left column, line 9, and JP-A 24539/1991, page 14, lower-left column to page 16, lower-right column. The dyestuffs which are bleached during processing include the compounds described in JP-A 139136/1977, 132334/1978, 501480/1981, 16060/1982, 68831/1982, 101835/1982, 182436/1984, 36145/1995, 199409/1995, JP-B 33692/1973, 16648/1975, 41734/1990, U.S. Pat. Nos. 4,088,497, 4,283,487, 4,548,896 and 5,187,049.

The dyestuff used herein is preferably one having at least one absorption peak in the wavelength range of 500 to 700 nm whereby the effect of anti-halation or irradiation prevention is obtained.

Illustrative examples of the useful dyestuffs used herein are given below although the invention is not limited thereto.

D-1

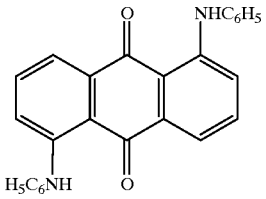

D-2

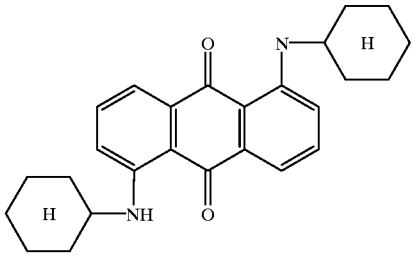

-continued

D-3

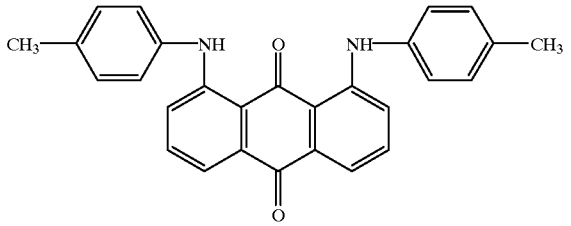

D-4

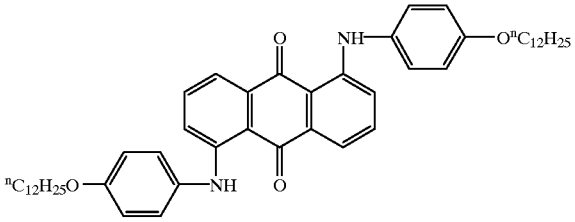

D-5

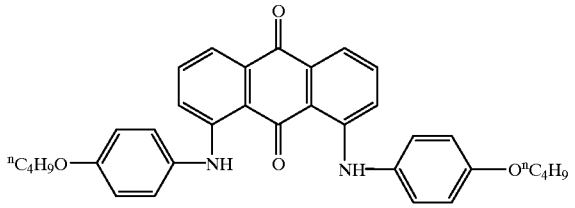

D-6

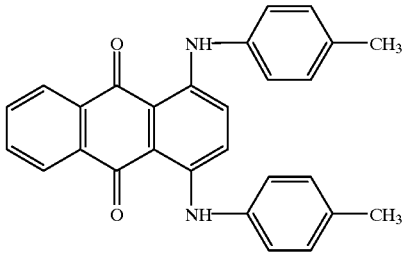

D-7

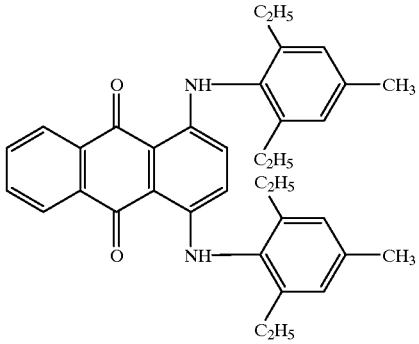

D-8

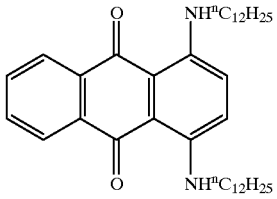

-continued

D-9

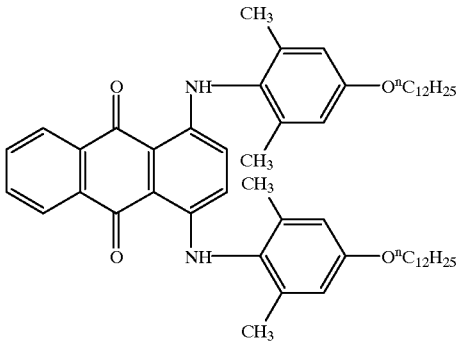

D-10

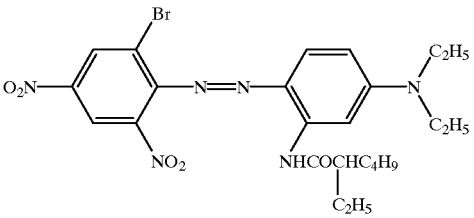

D-11

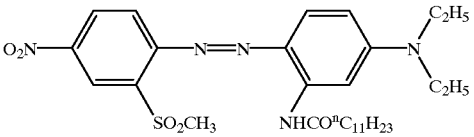

D-12

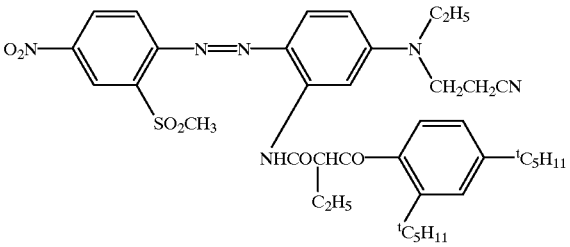

D-13

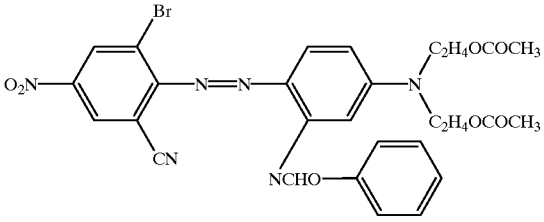

-continued

D-14

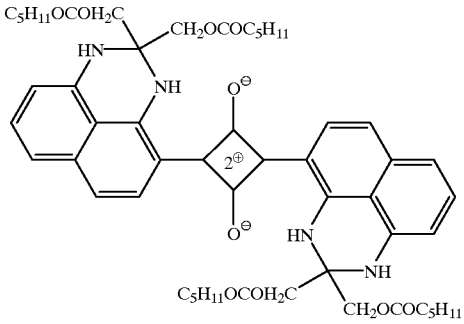

D-15

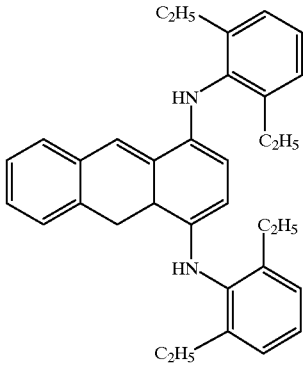

Water-insoluble and organic solvent-soluble polymers are preferred as the polymer used to form the polymeric microparticulates containing a dyestuff according to the invention.

Of the water-insoluble and organic solvent-soluble polymers used herein, the following examples are preferred although the invention is not limited thereto.

The invention favors the use of vinyl polymers obtained from monomers as described below. The monomers to form such preferred vinyl polymers include acrylates, for example, ethyl acrylate, butyl acrylate, 2-ethylhexyl acrylate, benzyl acrylate, and cyclohexyl acrylate;

methacrylates, for example, methyl methacrylate, ethyl methacrylate, and butyl methacrylate;

vinyl esters, for example, vinyl acetate and vinyl benzoate;

acrylamides, for example, tert-butylacrylamide, cyclohexylacrylamide and benzylacrylamide;

methacrylamides, for example, methoxyethylmethacrylamide;

olefins, for example, propylene, vinyl chloride, vinylidene chloride, butadiene, and 2,3-dimethylbutadiene;

styrenes, for example, styrene and methyl vinylbenzoate;

vinyl ethers, for example, methoxyethyl vinyl ether; and other monomers such as butyl crotonate, dimethyl itaconate, dimethyl maleate, phenyl vinyl ketone, glycidyl acrylate, glycidyl methacrylate, N-vinylpyrrolidone, acrylonitrile, and methacrylonitrile.

Two or more of the monomers (such as the above-described monomers) used in the polymer according to the invention are used as comonomers in accordance with various purposes (for example, for improving solubility). For the purpose of adjusting solubility or other factors, monomers having an acid group as exemplified below may be used as the comonomer insofar as the resulting copolymers are not water-soluble. Included in the comonomers are acrylic acid, methacrylic acid, itaconic acid, maleic acid, monoalkyl itaconates such as monomethyl itaconate, monoalkyl maleates such as monomethyl maleate, citraconic acid, and styrenesulfonic acid. These acids may be salts with alkali metals (e.g., Na and K) or ammonium ion.

Where hydrophilic monomers (which designate herein the monomers forming water-soluble homopolymers) among the vinyl monomers described above and other vinyl monomers used herein are used as the comonomer, the proportion of hydrophilic monomers in copolymers is not particularly limited insofar as the resulting copolymers are not water-soluble, and in most cases, the proportion is preferably up to 40 mol %, more preferably up to 20 mol %, and further preferably up to 10 mol %. Where the hydrophilic comonomer to be copolymerized with the monomer according to the invention has an acid group, the proportion of the acid group-bearing comonomer in the copolymer is usually up to 20 mol %, preferably up to 10 mol %. It is most preferred that such a comonomer is not contained.

The monomers in the polymers according to the invention are preferably methacrylate, acrylamide and methacrylamide monomers, and especially acrylamide and methacrylamide monomers.

The above-described polymers according to the invention may be used in admixture of two or more in an arbitrary combination. It is noted that the water-insoluble polymer used herein is a polymer having a solubility of up to 3 g, preferably up to 1 g, in 100 g of distilled water. The above-described oil-soluble polymers used herein should preferably contain 30 to 70% by weight of a component having a molecular weight of up to 40,000.

Several illustrative examples of the polymer which can be used herein are given below although the invention is not limited thereto. Note that numerical values in parentheses are % by weight.

Example Polvmer species

P-1) polyvinyl acetate

P-2) polymethyl methacrylate

P-3) polyethyl methacrylate

P-4) vinyl acetate-vinyl alcohol copolymer (95:5)

P-5) polybutyl acrylate

P-6) polybutyl methacrylate

P-7) butyl acrylate-acrylamide copolymer (95:5)

P-8) methyl methacrylate-vinyl chloride copolymer (70:30)

P-9) methyl methacrylate-styrene copolymer (90:10)

P-10) vinyl acetate-acrylamide copolymer (85:15)

P-11) vinyl chloride-vinyl acetate copolymer (65:35)

P-12) methyl methacrylate-acrylonitrile copolymer (65:35)

P-13) diacetone acrylamide-methyl methacrylate copolymer (50:50)

P-14) methyl methacrylate-cyclohexyl methacrylate copolymer (50:50)

P-15) methyl methacrylate-styrene-vinyl sulfonamide copolymer (70:20:10)

P-16) butyl acrylate-pentyl methacrylate-N-vinyl-2-pyrrolidone copolymer (38:38:24)

P-17) methyl methacrylate-butyl methacrylate-isobutyl methacrylate-acrylic acid copolymer (37:29:25:9)

P-18) butyl methacrylate-acrylic acid (95:5)

P-19) methyl methacrylate-acrylic acid copolymer (95:5)

P-20) benzyl methacrylate-acrylic acid copolymer (90:10)

P-21) butyl methacrylate-methyl methacrylate-acrylamide copolymer (35:35:30)

P-22) butyl methacrylate-methyl methacrylate-vinyl chloride copolymer (37:36:27)

P-23) butyl methacrylate-styrene copolymer (90:10)

P-24) methyl methacrylate-N-vinyl-2-pyrrolidone copolymer (90:10)

P-25) butyl methacrylate-vinyl chloride copolymer (90:19)

P-26) butyl methacrylate-styrene copolymer (70:30)

P-27) poly(N-tert-butylacrylamide)

P-28) diacetoneacrylamide-methyl methacrylate copolymer (62:38)

P-29) tert-butylacrylamide-methyl methacrylate copolymer (60:40)

P-30) methyl methacrylate-acrylonitrile copolymer (70:30)

P-31) poly(tert-butyl acrylate)

P-32) poly(4-chlorophenyl acrylate)

P-35) poly(benzyl methacrylate)

P-36) poly((α-pyrrolidone)

P-37) poly(ε-caprolactam)

P-38) poly(vinyl acetal)

These compounds can be prepared by well-known methods, for example, the methods described in U.S. Pat. No. 3,392,022 and JP-B 17367/1974.

The method for incorporating the dyestuff in polymeric microparticulates according to the invention is, for example, by dissolving the dyestuff and the polymer in a low-boiling organic solvent substantially insoluble in water (having a solubility of up to 30% in water) and emulsifying and dispersing the solution in a water phase optionally with the aid of an emulsifying aid such as a surfactant, and gelatin. It is preferred for storage stability to remove the unnecessary organic solvent after the dyestuff is incorporated into polymeric microparticulates.

A dispersion of polymeric microparticulates containing the dyestuff according to the invention may be prepared as follows. Both the dyestuff and the polymer are fully dissolved in a low-boiling organic solvent. The solution is then dispersed in water, preferably an aqueous solution of hydrophilic colloid, and more preferably an aqueous solution of gelatin, optionally with the aid of an emulsifying aid such as a surfactant, and by means of a ultrasonic mixer, colloid mill or dissolver, thereby forming a coating solution having both the dyestuff and polymer dispersed in microparticulate form. It is effective for the stability of the dispersion, especially for preventing the dyestuff from precipitating during storage, that the low-boiling organic solvent is removed from the dispersion. The means for removal of the low-boiling organic solvent includes distillation by heating in vacuum, distillation by heating under atmospheric pressure in a gas atmosphere such as nitrogen and argon, noodle water washing, or ultra-filtration. The low-boiling organic solvent used herein is an organic solvent useful in emulsification and dispersion, but is to be finally removed from the photosensitive element in the drying step after coating or by the removal means mentioned just above. The organic solvent has a low boiling point and such a solubility in water that it can be removed as by water washing. Examples of the low-boiling organic solvent include ethyl acetate, butyl acetate, ethyl propionate, sec-butyl alcohol, methyl ethyl ketone, methyl isobutyl ketone, β-ethoxyethyl acetate, methyl cellosolve acetate, and cyclohexanone. If necessary, organic solvents which are fully miscible with water, for example, methyl alcohol, ethyl alcohol, acetone and tetrahydrofuran may be used as part of the solvent. Further, the above organic solvents may be used in admixture of two or more. The pH of the emulsion is preferably neutral to acidic for the chemical stability of the compound itself and the stability of the dispersion. When gelatin is used in forming a dispersion, it is preferred to adjust the dispersion at a pH level which is at least 0.3, more preferably at least 0.5, most preferably 0.5 to 5.0, greater than the isoelectric point of gelatin because such a pH is effective for preventing the occurrence of syneresis (that is, spontaneous separation of a liquid from a gel due to contraction of the gel) when the gel is allowed to stand. For the pH adjustment, organic acids such as citric acid, oxalic acid, acetic acid, tartaric acid, succinic acid and malic acid or bases such as KOH and NaOH may be used.

In the practice of the invention, it is especially preferred to incorporate the dyestuff in polymer latex particulates as mentioned above and in the presence of a melting point depressant. The melting point depressant used herein is a substantially water-insoluble organic compound which is substantially fast to diffusion, and when mixed with an oil-soluble dyestuff, serves to lower its melting point.

The thus obtained emulsion contains particles preferably having a mean particle size of 0.02 to 2 μm, more preferably 0.04 to 0.4 μm. The particle size of particles in the emulsion can be measured by a suitable meter such as Nanosizer by Coulter in USA. The polymeric micro-particulates in the emulsion according to the invention may further contain various photographic hydrophobic substances insofar as the dyestuff therein may fully exert its effect. Examples of the photographic hydrophobic substances include high-boiling organic solvents, colored couplers, non-dye-forming couplers, developing agents, developing agent precursors, development inhibitors, development inhibitor precursors, UV absorbers, development accelerators, gradation adjusting agents such as hydroquinones, dyestuffs, dyestuff-release agents, antioxidants, fluorescent brighteners, and antifoggants. These hydrophobic substances may be used in combination of two or more. Also the dyestuffs may be used alone or in admixture of two or more.

In the practice of the invention, the melting point depressant is preferably used in an amount of 10 to 200% by weight, especially 20 to 100% by weight of the dyestuff. The polymer is preferably used in an amount of 10 to 400% by weight, especially 20 to 300% by weight of the dyestuff.

For the preparation of the microcapsules containing the dyestuff according to the invention, any of interfacial polymerization, internal polymerization, and external polymerization methods may be employed. Especially preferred is the interfacial polymerization method of emulsifying a core material of the dyestuff dissolved or dispersed in an organic solvent in an aqueous solution of a water-soluble polymer, thereby forming a wall of a polymer around oil droplets.

The organic solvent used herein is preferably selected from non-aqueous solvents having a boiling point of up to 150° C., especially 60 to 150° C., for example, carboxylates such as ethyl acetate and butyl acetate, toluene, xylene, and phosphates. Reactants to form a polymer are added to the inside and/or the outside of oil droplets.

Examples of the polymer include polyurethanes, polyureas, polyamides, polyesters, polycarbonates, urea-formaldehyde resins, melamine-formaldehyde resins, polyamic acid, polystyrene, styrene-methacrylate copolymers and styrene-acrylate copolymers. Preferred polymers are polyurethanes, polyureas, polyamides, polyesters, and polycarbonates, with the polyurethanes and polyureas being especially preferred. The polymers may be used in admixture of two or more.

Examples of the water-soluble polymer include gelatin, polyvinyl pyrrolidone and polyvinyl alcohol.

Where polyurea or polyurethane is used as the capsule wall-forming material, for example, polyfunctional isocyanates such as diisocyanate, triisocyanate, tetra-isocyanate, and polyisocyanate prepolymers are reacted with polyamines such as diamines, triamines, and tetramines, prepolymers containing at least two amino groups, piperadine or derivatives thereof, polyhydric alcohols, or water, in an aqueous solvent by the interfacial polymerization method, whereby microcapsule walls can be readily formed. It is especially preferred that the microcapsules have dense walls.

Composite walls consisting of polyurea and polyamide or composite walls consisting of polyurethane and polyamide can be prepared, for example, by using polyisocyanate and acid chloride or polyamine and polyhydric alcohol, adjusting the pH of an emulsifying medium serving as a reaction solution, and thereafter heating the reaction solution. JP-A 66948/1983 describes in detail the preparation of composite walls consisting of polyurea and polyamide. Capsules of polyamic acid are prepared, for example, through interfacial reaction between a polystyrene-maleic anhydride copolymer and a polyfunctional amine.

The microcapsules containing the dyestuff have a particle diameter of 0.3 to 5 μm. The polymer forming the walls around the dyestuff is preferably used in an amount of 30 to 99% by weight, especially 50 to 99% by weight.

By the above-described preparation method, microcapsules having an emulsion of the dyestuff included therein are obtained. In the photothermographic recording element, the organic solvent in the emulsion of the dyestuff is not left in the coated film as a result of drying after coating.

The pigments which can be used herein include commercially available ones and well-known ones described in the following literature. Included are Colour Index, edited by The Society of Dyers and Colourists; "New Edition Pigment Handbook," edited by the Japanese Pigment Technology Society, 1989; "Advanced Pigment Application Technology," CMC Publishing K.K., 1986, "Printing Ink Technology," CMC Publishing K.K., 1984, and W. Herbst & K. Hunger, "Industrial Organic Pigments," VCH Verlagsgesellshaft, 1993. More illustratively, organic pigments which can be used herein include azo pigments (e.g., azo lake pigments, insoluble azo pigments, condensed azo pigments, and chelate azo pigments), polycyclic pigments (e.g., phthalocyanine pigments, anthraquinone pigments, perylene and perinone pigments, indigo pigments, quinacridone pigments, dioxazine pigments, isoindolinone pigments, quinophthalone pigments, and diketopyrrolopyrrole pigments), dyeing lake pigments (e.g., lake pigments of acidic or basic dyes), and azine pigments. Inorganic pigments are also useful. Inter alia, phthalocyanine pigments, anthraquinone family indanthrone pigments, triarylcarbonium pigments belonging to the dyeing lake pigments, indigo pigments as well as inorganic pigments such as ultramarine, prussian blue and cobalt blue are preferable for obtaining favorable blue tone. In combination with the above blue pigments, red or purple pigments such as dioxazine pigments, quinacridone pigments, and diketopyrrolopyrrole pigments may be used for adjusting the tone.

Illustrative preferred examples of the pigment are given below. Examples of the blue pigment include phthalocyanine C.I. Pigment Blue 15, 15:1, 15:2, 15:3, 15:4, 15:6 (copper phthalocyanine), monochloro or low chlorinated copper phthalocyanine, C.I. Pigment Blue 16 (metal-free phthalocyanine), phthalocyanine having Zn, Al or Ti as the center metal, indanthrone family C.I. Pigment Blue 60, also known as vat dye, and halogen-substituted ones thereof, for example, C.I. Pigment Blue 64, 21, azo family C.I. Pigment Blue 25, indigo family C.I. Pigment Blue 66, C.I. Pigment Blue 63 belonging to lake pigments, C.I. Pigment Blue 1, 2, 3, 9, 10, 14, 18, 19, 24:1, 24:x, 56, 61 and 62 belonging to lake pigments of triarylcarbonium type acidic dyes or basic dyes. The red or purple pigments include dioxazine family C.I. Pigment Violet 23 and 37, azo family C.I. Pigment Violet 13, 25, 32, 44 and 50, C.I. Pigment Red 23, 52:1, 57:1, 63:2, 146, 150, 151, 175, 176, 185, 187 and 245, quinacridone family C.I. Pigment Violet 19 and 42, C.I. Pigment Red 122, 192, 202, 207, and 209, C.I. Pigment Violet 1, 2, 3, 27 and 39 belonging to triarylcarbonium type lake pigments, C.I. Pigment Red 81:1, perylene family C.I. Pigment Violet 29, anthraquinone family C.I. Pigment Violet 5:1, 31 and 33, thioindigo family C.I. Pigment Red 38 and 88.

The pigments which can be used herein may be either bare pigments as described above or surface-treated pigments. The methods of surface treatment include surface coating of resins or wax, application of surfactants, and binding of reactive substances (e.g., silane coupling agent, epoxy compounds, and polyisocyanates) to the pigment surface. These methods are described in "Properties and Application of Metal Soaps," Yuki Shobo K.K., "Printing Ink Technology," CMC Publishing K.K., 1984, and "Advanced Pigment Application Technology," CMC Publishing K.K., 1986.

Inter alia, the prevent invention favors the use of pigments having an absorption peak in the range of 500 to 700 nm in order that the image look in more blue black tone, and in the case of medical images, for example, for facilitating the diagnosis of medical images by coloring them blue. The absorbance is determined as the difference between a sample having a pigment-containing layer coated on a transmissive support and another sample having a pigment-free layer coated on a transmissive support.

In the practice of the invention, the pigment is used as a dispersion in a binder. A dispersant is selected in accordance with a particular binder and pigment, for example, from surfactant type low molecular weight dispersants and high molecular weight dispersants. For use in hydrophobic binders, it is more preferable from the standpoint of dispersion stability to use high molecular weight dispersants. Exemplary dispersants are described, for example, in JP-A 69949/1991 and EP 549,486.

The pigment used herein preferably has a particle size in the range of 0.01 to 10 $\mu$m, more preferably 0.05 to 1 $\mu$m after dispersion.

In dispersing the pigment in a binder, any of well-known dispersing techniques employed in the ink and toner manufacturing processes may be used. The dispersing machines include sand mills, attritors, pearl mills, super mills, ball mills, impellers, dispersers, KD mills, colloidal mills, dynatron mills, three-roll mills, and pressure kneaders. The detail is described in "Advanced Pigment Application Technology," CMC Publishing K.K., 1986.

The content of the pigment is preferably such that the photothermographic recording element may have an absorbance of 0.1 to 1.0. More illustratively, the content of the pigment is 1 mg/m$^2$ to 3 g/m$^2$ when expressed by a coverage or coating weight per square meter of the photothermographic recording element.

The antifoggant which is used herein may be any of well-known organic halides, for example, compounds as described in JP-A 119624/1975, 120328/1975, 121332/1976, 58022/1979, 70543/1981, 99335/1981, 90842/1984, 129642/1986, 129845/1987, 208191/1994, 5621/1995, 2781/1995, and 15809/1996, U.S. Pat. Nos. 5,340,712, 5,369,000, 5,464,737, 3,874,946, 4,756,999, 5,340,712, EP 605981A1, 622666A1, 631176A1, JP-B 165/1979, JP-A 2781/1995, U.S. Pat. Nos. 4,108,665 and 4,442,202.

In the practice of the invention, polyhalogenated compounds of the following general formula (I) are also useful.

(I)

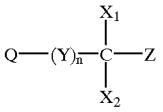

In formula (I), Q is an alkyl, aryl or heterocyclic group, each of $X_1$ and $X_2$ is a halogen atom, Z is a hydrogen atom or electron attractive group, Y is —C(=O)—, —SO— or —$SO_2$—, and letter n is equal to 0 or 1.

The aryl group represented by Q may be monocyclic or a fused ring, preferably a monocyclic or bicyclic aryl group of 6 to 30 carbon atoms (e.g., phenyl or naphthyl), more preferably phenyl or naphthyl, especially phenyl.

The heterocyclic group represented by Q is a 3- to 10-membered, saturated or unsaturated, heterocyclic group containing at least one atom selected from nitrogen, oxygen and sulfur, which may be monocyclic or form a fused ring with another ring.

Preferred heterocyclic groups are 5- or 6-membered unsaturated heterocyclic groups which may have a fused ring, more preferably 5- or 6-membered aromatic heterocyclic groups which may have a fused ring. Further preferred are 5- or 6-membered aromatic heterocyclic groups which may have a nitrogen atom-containing fused ring, especially 5- or 6-membered aromatic heterocyclic groups which may have a fused ring containing one to four nitrogen atoms. Exemplary heterocycles in these heterocyclic groups include imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzthiazole, indolenine, and tetraazaindene; more preferably imidazole, pyridine, pyrimidine, pyrazine, pyridazine, triazole, triazine, thiadiazole, oxadiazole, quinoline, phthalazine, naphthyridine, quinoxaline, quinazoline, cinnoline, tetrazole, thiazole, oxazole, benzimidazole, benzoxazole, benzthiazole, and tetraazaindene; further preferably imidazole, pyridine, pyrimidine, pyrazine, pyridazine, triazole, triazine, thiadiazole, quinoline, phthalazine, naphthyridine, quinoxaline, quinazoline, cinnoline, tetrazole, thiazole, benzimidazole, and benzthiazole; most preferably pyridine, thiadiazole, quinoline, and benzthiazole.

The aryl group and heterocyclic group represented by Q may have another substituent in addition to —$(Y)_n$—$CZ(X_1)(X_2)$. Such substituents include alkyl, alkenyl, aryl, alkoxy, aryloxy, acyloxy, acyl, alkoxycarbonyl, aryloxycarbonyl, acyloxy, acylamino, alkoxycarbonylamino, aryloxycarbonylamino, sulfonylamino, sulfamoyl, carbamoyl, sulfonyl, ureido, phosphoramido, halogen, cyano, sulfo, carboxyl, nitro and heterocyclic groups; preferably alkyl, aryl, alkoxy, aryloxy, acyl, acylamino, alkoxycarbonylamino, aryloxycarbonylamino, sulfonylamino, sulfamoyl, carbamoyl, ureido, phosphoramido, halogen, cyano, nitro and heterocyclic groups; more preferably alkyl, aryl, alkoxy, aryloxy, acyl, acylamino, sulfonylamino, sulfamoyl, carbamoyl, halogen, cyano, nitro and heterocyclic groups; most preferably alkyl groups, aryl groups and halogen atoms.

The alkyl group represented by Q may be selected from normal, branched or cyclic groups, preferably having 1 to 30 carbon atoms, more preferably 1 to 15 carbon atoms, for example, methyl, ethyl, n-propyl, isopropyl and tert-octyl.

The alkyl group represented by Q may have another substituent in addition to —$(Y)_n$—$CZ(X_1)(X_2)$ . The substituents are as exemplified for the substituents on the heterocyclic or aryl group represented by Q. Preferred substituents include alkenyl, aryl, alkoxy, aryloxy, acyloxy, acylamino, alkoxycarbonylamino, aryloxycarbonylamino, sulfonylamino, alkylthio, arylthio, ureido, phosphoramido, hydroxy, halogen, and heterocyclic groups; more preferably aryl, alkoxy, aryloxy, acylamino, alkoxycarbonylamino, aryloxycarbonylamino, sulfonylamino, ureido, phosphoramido groups, and halogen atoms; further preferably aryl, alkoxy, aryloxy, acylamino, sulfonylamino, ureido, and phosphoramido groups.

Y is —C(=O)—, —SO— or —$SO_2$ - preferably —C(=O)— or —$SO_2$—, more preferably —$SO_2$—.

Letter n is equal to 0 or 1, preferably 1.

Each of $X_1$ and $X_2$ is a halogen atom. The halogen atoms represented by $X_1$ and $X_2$ may be the same or different and are selected from fluorine, chlorine, bromine and iodine atoms, preferably chlorine, bromine and iodine atoms, more preferably chlorine and bromine atoms, most preferably bromine atoms.

Z is a hydrogen atom or electron attractive group. The electron attractive group represented by Z is preferably a substituent having a $\sigma_p$ value of at least 0.01, more preferably at least 0.1. With respect to the Hammett's substituent constant, reference should be made to Journal of Medicinal Chemistry, 1973, Vol. 16, No. 11, 1207–1216.

Preferably, Z is an electron attractive group, more preferably a halogen atom, an aliphatic aryl or heterocyclic sulfonyl group, an aliphatic aryl or heterocyclic acyl group, an aliphatic aryl or heterocyclic oxycarbonyl group, a carbamoyl group or a sulfamoyl group, most preferably a halogen atom. Of the halogen atoms, chlorine, bromine and iodine atoms are preferred, and chlorine and bromine atoms are more preferred, with bromine atoms being most preferred.

Among the polyhalogenated compounds, compounds of the following general formula (I-a) are more preferred.

(I-a)

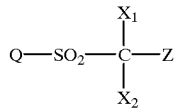

In formula (I-a), Q, $X_1$, $X_2$, and Z are as defined in formula (I), with their preferred ranges being also as defined in formula (I).

Illustrative non-limiting examples of the polyhalogenated compounds which can be used herein are given below.

II-1

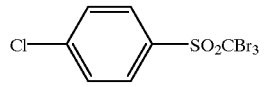

II-2

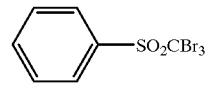

II-3

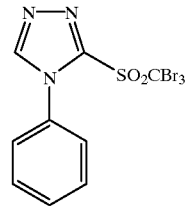

II-4

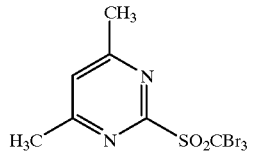

II-5

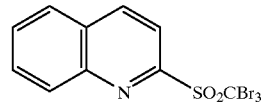

II-6

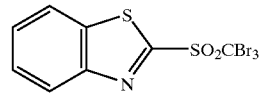

II-7

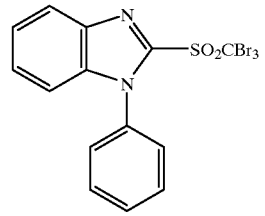

II-8

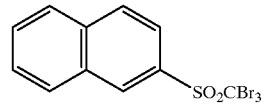

-continued
II-9
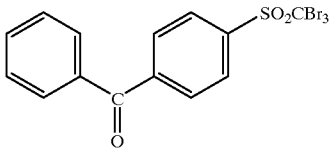
II-10
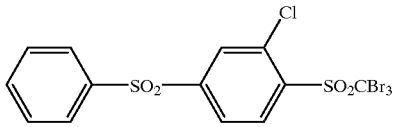
II-11
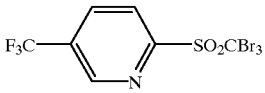
II-12
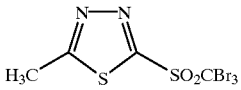
II-13
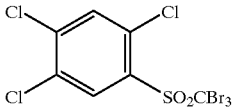
II-14
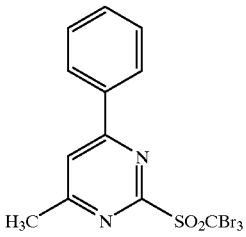
II-15
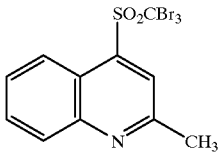
II-16
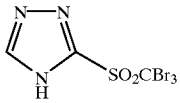
II-17
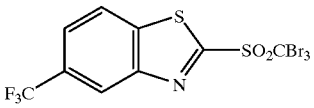
II-18
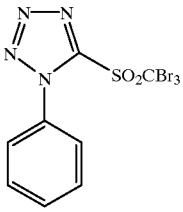
-continued
II-19
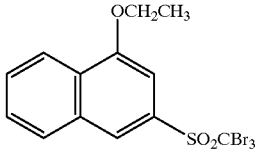
II-20
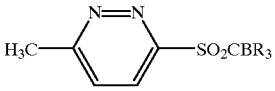
II-21
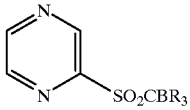
II-22
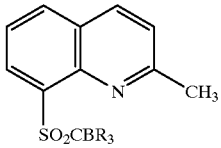
II-23
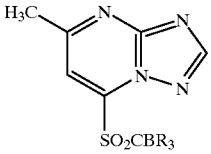
II-24
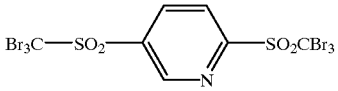
II-25
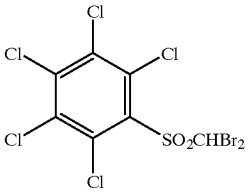
II-26
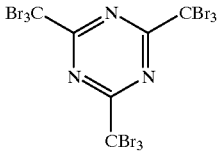
II-27
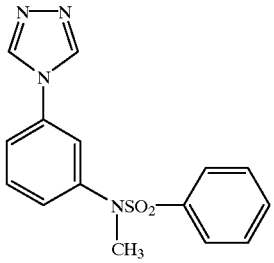

-continued

II-28

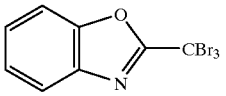

II-29

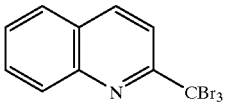

II-30

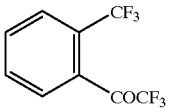

II-31

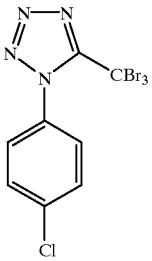

II-32

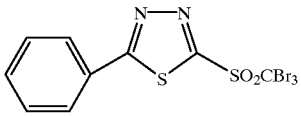

II-33

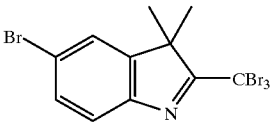

II-34

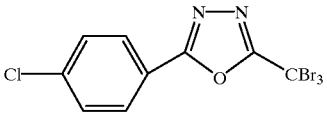

II-35

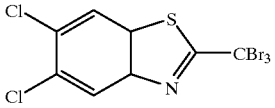

II-36

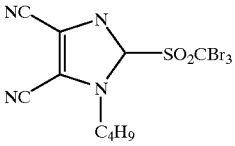

II-37

$CH_3(CH_2)_2CBr_2SO_2CBr_3$

II-38

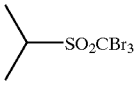

The amount of the polyhalogenated compound added is preferably 10 mg/m$^2$ to 3 g/m$^2$, more preferably 50 mg/m$^2$ to 1 g/m$^2$ when expressed by a coverage per square meter of the recording element.

The polyhalogenated compound may be added in any desired form such as solution, powder or solid particle dispersion although it is preferably added in a solid particle dispersion form to a photosensitive layer.

The solid particle dispersion of the polyhalogenated compound may be prepared by well-known comminuting means such as ball mills, vibrating ball mills, sand mills, colloidal mills, jet mills, and roller mills. Dispersing aids may be used for facilitating dispersion. The polyhalogenated compound may also be added as a solution obtained by mixing it with other additives such as sensitizing dyes, reducing agents and toners.

The photothermographic recording element of the invention contains a photosensitive silver halide.

In the practice of the invention, the photosensitive silver halide can be used in an amount of 1 to 50 mol %, preferably 3 to 20 mol % of the organic silver salt.

The silver halide may be any of photosensitive silver halides such as silver bromide, silver iodide, silver chloride, silver bromoiodide, silver chlorobromoiodide, and silver chlorobromide. The silver halide is photosensitive and may have any shape such as cubic, rhombic, tabular and tetrahedral shapes, but is not limited thereto. Crystals may epitaxially grow on particles of such shape. The amount of the silver halide used is preferably 0.1 to 50 mol %, more preferably 0.5 to 20 mol % of the non-photosensitive silver salt.

The silver halide used herein may be used without modification thereof. However, it can be chemically sensitized by chemical sensitizers such as compounds containing sulfur, selenium, tellurium or the like, compounds containing gold, platinum, palladium, rhodium, iridium or the like, reducing agents such as tin halides or combinations thereof. The detail of these procedures is described in T. H. James, "The Theory of the Photographic Process," 4th Ed., Chap. 5, pp. 149–169.

The silver halide may be added to the emulsion layer in any desired manner to position the silver halide near the non-photosensitive silver salt so that the silver halide may act as a catalyst for the silver salt. The silver halide and the organic silver salt which have been separately formed or "pre-formed" in binders may be mixed, before use, to prepare a coating solution. It is also effective to mix them in a ball mill for an extended period of time. It is also effective to employ a method involving adding a halogen-bearing compound to a prepared non-photosensitive silver salt for thereby converting part of the silver of the non-photosensitive silver salt into a silver halide. These methods for preparing the silver halide and the organic silver salt and the methods for mixing them are well known in the art and described in Research Disclosure, June 1978, Item No. 17029 and U.S. Pat. No. 3,700,458.

The preformed silver halide emulsion according to the invention may not be washed or washed to remove the soluble salts. In the latter case, the soluble salts may be removed by cooling coagulation and leaching by the procedures described, for example, in U.S. Pat. Nos. 2,618,556, 2,614,928, 2,565,418, 3,241,969, and 2,489,341, or the emulsion may be coagulated and washed.

The silver halide grains may be of any crystallinity and include cubic, tetrahedral, rhombic, tabular, laminar and plate shapes, though not limited thereto.

The content of the silver halide is preferably 0.03 g/m$^2$ to 1 g/m$^2$, especially 0.1 g/m$^2$ to 0.5 g/m$^2$, when expressed by a coverage per square meter of the recording element.

In the practice of the invention, a non-photosensitive organic silver salt is preferably used.

The non-photosensitive organic silver salt which can be used herein is relatively stable to light, but forms a silver image when heated at 80° C. or higher in the presence of an exposed photocatalyst (as typified by a photographic silver salt) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having an overall stability constant in the range of 4.0 to 10.0. The non-photosensitive silver salt is preferably contained in the recording element in an amount of about 5 to 30% by weight of an image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof. The coverage of the non-photosensitive silver salt, expressed by a silver weight, is preferably 0.1 g to 5 g, more preferably 0.5 g to 3 g per square meter of the recording element.

The shape of the organic silver salt which can be used herein is not particularly limited although needle crystals having a minor axis and a major axis are preferred. The inverse proportional relationship between the size of silver salt crystal grains and their covering power that is well known for photosensitive silver halide materials also applies to the photothermographic recording element of the present invention. That is, as organic silver salt grains constituting image forming regions of the photothermographic recording element increase in size, the covering power becomes smaller and the image density becomes lower. It is thus necessary to reduce the grain size of the organic silver salt. In the practice of the invention, grains should preferably have a minor axis of 0.01 $\mu$m to 0.20 $\mu$m and a major axis of 0.10 $\mu$m to 5.0 $\mu$m, more preferably a minor axis of 0.01 $\mu$m to 0.15 $\mu$m and a major axis of 0.10 $\mu$m to 4.0 $\mu$m. The grain size distribution of the organic silver salt is desirably monodisperse. The monodisperse distribution means that a standard deviation of the length of minor and major axes divided by the length, respectively, expressed in percent, is preferably up to 100%, more preferably up to 80%, most preferably up to 50%. The method for measuring the shape of the organic silver salt can rely on an image of an organic silver salt dispersion under a transmission electron microscope. Another method for determining a monodisperse distribution is to determine a standard deviation of a volume weighed mean diameter of the organic silver salt. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the autocorrelation function of the fluctuation of scattering light relative to a time change, and obtaining the grain size (volume weighed mean diameter) therefrom.

It is also known that half soaps of silver are convenient. Inter alia, one preferred example is an equimolar mixture of silver behenate and behenic acid, which is prepared by precipitation from an aqueous solution of commercially available behenic acid and has a silver content of about 14.5%. Since a transparent film material requires a transparent coating, an all soap of behenic acid containing not more than about 40% of free behenic acid and having a silver content of about 25.2% on analysis may be used. The method used to prepare a dispersion of the silver soap is well known in the art and disclosed in Research Disclosure, April 1983, Item No. 22812, Research Disclosure, October 1983, Item No. 23419, and U.S. Pat. No. 3,985,565.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido) benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The binder used in the photosensitive layer (or emulsion layer) according to the invention may be arbitrarily selected from well-known naturally occurring polymers and synthetic resins, for example, gelatin, polyvinyl alcohol, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included in this category. Preferred polymers are polyvinyl butyral, butylethyl cellulose, methacrylate copolymers, maleic anhydride ester copolymers, polystyrene, polyethylene, polypropylene and butadiene-styrene copolymers. If necessary, these polymers may be used in admixture of two or more.

The polymer is used in a sufficient amount to carry other components therein. That is, the polymer is used in such a range that it may effectively function as a binder. The effective range may be properly determined by those skilled in the art. Taken at least as a measure for carrying at least the organic silver salt, the proportion of the binder to the organic silver salt is preferably in the range of from 15:1 to 1:5, more preferably from 10:1 to 1:2, as expressed in weight ratio.

According to the invention, the binder in the emulsion layer may be a hydrophobic polymer dispersed in an aqueous solvent. The aqueous solvent is water or a mixture of water and up to 70% by weight of a water-miscible organic solvent. Examples of the water-miscible organic solvents include methanol, ethanol, propanol, ethyl acetate, dimethylformamide, methyl cellosolve, and butyl cellosolve. Exemplary solvent compositions are a 90/10, 70/30 or 50/50 mixture of water/methyl alcohol, a 90/10 mixture of water/isopropanol, a 95/5 mixture of water/butyl cellosolve, a 95/5 mixture of water/dimethylformamide, and a 90/5/5 or 80/15/5 mixture of water/methyl alcohol/dimethylformamide, all expressed in a weight ratio.

The "dispersion" means that the polymer is not thermodynamically dissolved in a solvent, but dispersed in an aqueous solvent in a latex, micelle or molecular dispersion form.

In the practice of the invention, the use of an aqueous latex in such dispersed state (polymer latex) is preferred.

With respect to the polymer latex used herein, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. Dispersed particles should preferably have a mean particle size of about 1 to 50,000 nm, more preferably about 5 to 1,000 nm. No particular limit is imposed on the particle size distribution of dispersed particles, and the dispersion may have either a wide particle size distribution or a monodisperse particle size distribution.

The inventive polymer latex used herein may be either a latex of the conventional uniform structure or a latex of the so-called core/shell type. In the latter case, better results are sometimes obtained when the core and the shell have different glass transition temperatures.

The inventive polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex," Kobunshi Kankokai, 1970.

As the binder used herein, polymers having an "equilibrium moisture content at 25° C. and RH 60%" of up to 2% by weight are especially preferable. The lower limit of equilibrium moisture content is not critical although it is preferably 0.01% by weight, more preferably 0.03% by weight. The equilibrium moisture content (Weq) of a polymer at 25° C. and RH 60% is expressed by the following expression:

$$Weq=(W_1-W_0)/W_0\times 100\%$$

using the weight ($W_1$) of the polymer conditioned in an atmosphere of 25° C. and RH 60% until equilibrium is reached and the weight ($W_0$) of the polymer in an absolute dry condition at 25° C.

The polymer used herein is not critical insofar as it is dispersible in the aqueous solvent. For example, acrylic resins, polyester resins, polyurethane resins, vinyl chloride resins, vinylidene chloride resins, rubbery resins (e.g., SBR and NBR resins), vinyl acetate resins, polyolefin resins, and polyvinyl acetal resins are included. The polymer may be either a homopolymer or a copolymer having two or more monomers polymerized together. The polymers may be linear or branched. The polymers may be crosslinked together. The polymers preferably have a number average molecule weight of about 1,000 to about 1,000,000, more preferably about 3,000 to about 500,000. Polymers with a number average molecular weight of less than 1,000 would generally provide a low film strength after coating, resulting in a photosensitive material susceptible to crazing. Of these polymers, styrene-butadiene copolymers included in the SBR resins are also preferable.

The "styrene-butadiene copolymers" used herein are polymers containing styrene and butadiene in their molecular chain. The molar ratio of styrene to butadiene is preferably from 99:1 to 40:60, more preferably from 95:5 to 50:50, and most preferably from 90:10 to 60:40.

The "styrene-butadiene copolymer" used herein may have another monomer copolymerized with styrene and butadiene. Examples of the other monomer include esters of acrylic acid and methacrylic acid such as methyl methacrylate and ethyl methacrylate, acids such as acrylic acid, methacrylic acid, and itaconic acid, and other vinyl monomers such as acrylonitrile and divinyl benzene. Such copolymers should preferably have a styrene-butadiene content of at least 50% by weight, more preferably 50 to 99% by weight, most preferably 60 to 97% by weight.

Preferably the styrene-butadiene copolymer used herein has a number average molecular weight of about 2,000 to 1,000,000, more preferably about 5,000 to 500,000.

The styrene-butadiene copolymer used herein is generally a random copolymer. The copolymer may be a linear, branched or crosslinked. Most often, the copolymer is used in the form of particles having a mean particle size of 0.01 to 1 $\mu$m.

Illustrative examples of the polymer used herein include acrylic resins available under Sebian A-4635, 46583 and 4601 (Daicell Chemical Industry K.K.) and Nipol LX811, 814, 820, 821 and 857 (Nippon Zeon K.K.), and polyester resins available under FINETEX ES650, 611, 679, 675, 525, 801 and 850 (Dai-Nippon Ink & Chemicals K.K.) and Wdsize and WMS (Eastman Chemical Products, Inc.). Illustrative examples of the rubbery (SBR) resin or styrene-butadiene copolymer used herein are given below.

P-1 latex of $—St_{70}—Bu_{30}—$(Mn=30,000)

P-2 latex of $—St_{60}—Bu_{37}—MAA_3—$(Mn=45,000)

P-3 latex of $—St_{50}—Bu_{40}—AN_7—AA_3—$(Mn=70,000)

P-4 latex of $—St_{70}—Bu_{20}—DVB_5—MAA_5—$(Mn=100,000)

P-5 latex of $—St_{50}—Bu_{30}—AN_{15}—IA_5—$(Mn=60,000)

In the formulae, symbols represent constituent units derived from monomers, numerical values are % by weight, and Mn is a number average molecular weight.

St: styrene, Bu: butadiene, MAA: methacrylic acid,

AN: acrylonitrile, AA: acrylic acid,

DVB: divinyl benzene, IA: itaconic acid.

Commercially available examples of the styrene-butadiene copolymer used herein are Lacstar 3307B, DS-205 and 602, Lacstar DS203, 7132C and DS807 by Dai-Nippon Ink & Chemicals K.K., Nipol 2507, Lx416, Lx433, Lx410, Lx430, and Lx435 by Nippon Zeon K.K., and DL-670, L-5702 and 1235 by Asahi Chemicals K.K.

In the practice of the invention, a coating solution of the preferred styrene-butadiene copolymer as the binder is preferably prepared to a solid concentration of 0.5 to 12% by weight, more preferably 1 to 8% by weight, using the above-described solvent.

From the environmental and cost considerations, coating using the aqueous solvent is preferred. Better results are obtained when an aqueous latex, especially a latex of a polymer having an equilibrium moisture content of up to 2% by weight is used, because the fog increase under a high humidity atmosphere is suppressed.

According to the invention, the photothermographic emulsion, typically a silver halide emulsion may be coated on various supports. Typical supports include polyester film, subbed polyester film, poly(ethylene terephthalate) film, cellulose nitrate film, cellulose ester film, poly(vinyl acetal) film, polycarbonate film and associated or resinous materials, as well as glass, paper and metals. Flexible substrates, especially baryta and/or partially acetylated α-olefin polymers, and especially polyethylene terephthalate are typically used. The support may be either transparent or slightly opaque, preferably transparent.

In the photothermographic recording element of the invention, a surface protective layer may be formed on the photosensitive emulsion layer.

In the practice of the invention, the binder used in the surface protective layer is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly (vinyl pyrrolidone), casein, starch, poly(acrylic acid), poly (methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, polylvinyl acetate), cellulose esters, and polyamides. The binder may be dispersed in water, organic solvent or latex emulsion and coated to form a layer.

The matte agents used herein are generally microparticulate organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-α-methylstyrene copolymers, polystyrene, styrene-divinylbenzene copolymers, polyvinyl is acetate, polyethylene carbonate, and polytetrafluoroethylene; exemplary cellulose derivatives include methyl cellulose, cellulose acetate, and cellulose acetate propionate; exemplary starch derivatives include carboxy-starch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. No particular limit is imposed on the size of the matte agent. The matte agent of any particle size may be used although matte agents having a particle size of about 0.1 μm to 30 μm, especially about 0.3 to 15 μm are preferably used in the practice of the invention. The particle size distribution of the matte agent may be either narrow or wide. Nevertheless, since the haze and surface luster of coated films are largely affected by the matte agent, it is possible to adjust the particle size, shape and particle size distribution of a matte agent as desired during preparation of the matte agent or by mixing plural matte agents. It is preferred to use matte agents of spherical shape, especially those of true spherical shape commercially available as Sildex H-31, H-51 and H-121 from Dokai Chemical K.K. and Tospearl 145 and 120 from Toshiba Silicone K.K.

In the photosensitive recording element of the invention, the matte agent is preferably added to an outermost surface layer, a layer functioning as an outermost surface layer or a layer close to the outer surface. A degree of matte can be controlled by changing the particle size and addition amount of the matte agent. A degree of matte-can be of smaller values by increasing the particle size of the matte agent or increasing the amount of the matte agent added. Increasing the particle size of the matte agent is especially effective in reducing the degree of matte. A degree of matte corresponding to a Bekk smoothness of 10 to 250 seconds, especially 50 to 180 seconds is preferred.

The photothermographic recording element of the invention may have a backing layer (or back layer) on the side of a support which is remote from the silver halide emulsion layer (or photosensitive layer).

In the practice of the invention, the binder used in the back layer is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, polylvinyl acetate), cellulose esters, and polyamides. The binder may be dispersed in water, organic solvent or emulsion, which is coated to form a layer.

The invention favors to use a reducing agent.

The reducing agent for the non-photosensitive silver salt may be any of substances, preferably organic substances, that reduce silver ion into metallic silver. Conventional photographic developing agents such as Phenidone, hydroquinone and catechol are useful although bisphenols and hindered phenols are preferred reducing agents. The reducing agent should preferably be contained in an amount of 2 to 30% by weight of the image forming layer.

There are disclosed a variety of reducing agents for the non-photosensitive silver salt. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2-dihydroxy-1,1-binaphthyl, 6,6'-dibromo-2,2'-dihydroxy-1,1'-binaphthyl, and bis(2-hydroxy-1-naphthyl)-methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl) methane, 2,2-bis(4-hydroxy-3-methylphenyl)propane, 4,4-ethylidene-bis(2-t-butyl-6-methylphenol), and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; and 3-pyrazolidones and certain indane-1,3-diones.

These reducing agents may be contained as solids in the image forming layer or a layer disposed adjacent thereto. The size of solid particles is preferably in the visually unperceivable range, with a mean diameter of up to 5 $\mu$m, especially up to 1 $\mu$m being preferred. The lower limit of the particle diameter is not critical although it is usually about 0.05 $\mu$m, preferably about 0.1 $\mu$m.

The invention favors to use a toner.

A higher optical density is sometimes achieved when an additive known as a "toner" for improving images is contained. The toner is also sometimes advantageous in forming black silver images. The toner is preferably used in an amount of 0.1 to 50 mol %, especially 0.5 to 20 mol % per mol of silver on the image forming layer-bearing side. The toner may take the form of a so-called precursor which is modified so as to exert its effective function only at the time of development.

The toners used herein may be toners commonly used in photothermographic elements as disclosed in U.S. Pat. Nos. 3,080,254, 3,847,612 and 4,123,282.

Examples of the toner include phthalimide and N-hydroxyphthalimide; cyclic imides such as succinimide, pyrazoline-5-one, quinazoline, 3-phenyl-2-pyrazolin-5-one, 1-phenylurazol, quinazoline and 2,4-thiazolidinedione; naphthalimides such as N-hydroxy-1,8-naphthalimide; cobalt complexes such as cobalt hexamine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl)aryldicarboxyimides such as (N,N-dimethyl-aminomethyl)phthalimide and N,N-(dimethylaminomethyl)-naphthalene-2,3-dicarboxyimide; blocked pyrazoles, isothiuronium derivatives and certain optical fading agents such as N,N'-hexamethylenebis(l-carbamoyl-3,5-dimethyl-pyrazole), 1,8-(3,6-diazaoctane)bis(isothiuroniumtrifluoroacetate) and 2-tribromomethylsulfonyl-benzothiazole; 3-ethyl-5-{(3-ethyl-2-benzothiazolinylidene)-1-methyl-ethylidene}-2-thio-2,4-oxazolidinedione; phthalazinone, phthalazinone derivatives or metal salts, or derivatives such as 4-(1-naphthyl)phthalazinone, 6-chlorophthalazinone, 5,7-dimethoxyphthalazinone and 2,3-dihydro-1,4-phthalazinedione; combinations of phthalazinone with phthalic acid derivatives (e.g., phthalic acid, 4-methylphthalic acid, 4-nitrophthalic acid, and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asymtriazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene.

Of these, the most preferred toners are phthalimides, phthalazinones, and combinations of phthalazines with phthalic acids.

These toners may be contained as solids in the image forming layer or a layer disposed adjacent thereto. The size of solid particles is preferably in the visually unperceivable range, with a mean diameter of up to 5 $\mu$m, especially up to 1 $\mu$m being preferred. The lower limit of the particle diameter is not critical although it is usually about 0.01 $\mu$m.

In the practice of the invention, there may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), ibid., Item 1831 X (August 1979, page 437) and the references cited therein. It is advantageous to select a sensitizing dye having appropriate spectral sensitivity to the spectral properties of a particular light source of various laser imagers, scanners, image setters and printing plate-forming cameras.

Exemplary dyes for spectral sensitization to red light include compounds I-1 to I-38 described in JP-A 18726/1979, compounds I-1 to I-35 described in JP-A 75322/1994, compounds I-1 to I-34 described in JP-A 287338/1995, dyes 1 to 20 described in JP-B 39818/1980, compounds I-1 to I-37 described in JP-A 284343/1987, and compounds I-1 to I-34 described in JP-A 287338/1995 for red light sources such as He-Ne lasers, red semiconductor lasers and LED.

For semiconductor laser light sources in the wavelength range of 750 to 1,400 nm, spectral sensitization may be advantageously done with various known dyes including cyanine, merocyanine, styryl, hemicyanine, oxonol, hemioxonol, and xanthene dyes. Useful cyanine dyes are cyanine dyes having a basic nucleus such as a thiazoline, oxazoline, pyrroline, pyridine, oxazole, thiazole, selenazole and imidazole nucleus. Preferred examples of the useful merocyanine dye contain an acidic nucleus such as a thiohydantoin, rhodanine, oxazolidinedione, thiazolinedione, barbituric acid, thiazolinone, malononitrile, and pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,493, BP 1,466,201, 1,469,117, and 1,422,057, JP-B 10391/1991 and 52387/1994, JP-A 341432/1993, 194781/1994, and 301141/1994.

Especially preferred dye structures are cyanine dyes having a thioether bond-containing substituent group, examples of which are the dyes described in JP-A 58239/1987, 138638/1991, 138642/1991, 255840/1992, 72659/1993, 72661/1993, 222491/1994, 230506/1990, 258757/1994, 317868/1994, and 324425/1994, Publication of International Patent Application No. 500926/1995, and U.S. Pat. No. 5,541,054; dyes having a carboxylic group, examples of which are the dyes described in JP-A 163440/1991, 301141/1994 and U.S. Pat. No. 5,441,899; and merocyanine dyes, polynuclear merocyanine dyes, and polynuclear cyanine dyes, examples of which are the dyes described in JP-A 6329/1972, 105524/1974, 127719/1976, 80829/1977, 61517/1979, 214846/1984, 6750/1985, 159841/1988, 35109/1994, 59381/1994, 146537/1995, 146537/1995, Publication of International Patent Application No. 50111/1993, BP 1,467,638, and U.S. Pat. No. 5,281,515.

Also, dyes capable of forming the J-band are disclosed in U.S. Pat. Nos. 5,510,236, 3,871,887 (Example 5), JP-A 96131/1990 and 48753/1984, and they are useful in the practice of the invention.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in Research Disclosure, Vol. 176, 17643 (December 1978), page 23, IV J and JP-B 25500/1974 and 4933/1968, JP-A 19032/1984 and 192242/1984.

The sensitizing dyes may be used in admixture of two or more. The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process which has been ascertained effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

Although the sensitizing dye may be added at any of the above-mentioned stages, it is preferably added prior to the addition of silver halide to the coating solution. The amount of the sensitizing dye used may be an appropriate amount complying with sensitivity and fog although the preferred amount is about $10^{-6}$ to 1 mol, more preferably $10^{-4}$ to $10^{-1}$ mol per mol of the silver halide in the photosensitive layer.

The silver halide emulsion according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in BP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, triazines as described in U.S. Pat. Nos. 4,128,557, 4,137,079, 4,138,365 and 4,459,350, and phosphorus compounds as described in U.S. Pat. No. 4,411,985.

The emulsion used herein may contain plasticizers and lubricants such as polyhydric alcohols (e.g., glycerin and diols as described in U.S. Pat. No. 2,960,404), fatty acids and esters thereof as described in U.S. Pat. Nos. 2,588,765 and 3,121,060, and silicone resins as described in BP 955,061.

The photothermographic recording element of the invention may contain image dye stabilizers. Such image dye stabilizers are exemplified in BP 1,326,889, U.S. Pat. Nos. 3,432,300, 3,698,909, 3,574,627, 3,573,050, 3,764,337, and 4,042,394.

The photothermographic recording element of the invention may have an antistatic or electroconductive layer, for example, a layer containing soluble salts (e.g., chlorides and nitrates), an evaporated metal layer, or a layer containing ionic polymers as described in U.S. Pat. Nos. 2,861,056 and 3,206,312 or insoluble inorganic salts as described in U.S. Pat. No. 3,428,451.

EXAMPLE

Examples of the invention are given below by way of illustration although the invention is not limited thereto.

It is first described how to prepare the dispersions of polymeric microparticulates and microcapsules containing dyestuffs according to the invention used in Examples 1 to 4.

Preparation of Dispersions of Polymeric Microrarticulates Containing Dyestuffs A solution containing 2 g of exemplary inventive dyestuff D-7 shown above and 6 g of a methyl methacrylate-methacrylic acid copolymer (85:15) in 40 ml of ethyl acetate was heated at 60° C. for dissolution and added to 100 ml of an aqueous solution containing 5 g of polyvinyl alcohol. The mixture was finely dispersed by a high-speed agitator (Homogenizer by Nippon Seiki K.K.) at 12,000 rpm for 5 minutes, obtaining an emulsified dispersion P-1 of polymeric microparticulates having a mean particle size of 0.3 μm.

An emulsified dispersion P-2 of polymeric microparticulates was obtained by the same procedure as dispersion P-1, but using 2 g of exemplary inventive dyestuff D-10 instead of dyestuff D-7.

An emulsified dispersion P-3 of polymeric microparticulates was obtained by the same procedure as dispersion P-1, but using 2 g of exemplary inventive dyestuff D-14 instead of dyestuff D-7.

An emulsified dispersion P-4 of polymeric microparticulates was obtained by the same procedure as dispersion P-1, but using 6 g of a polybutyl methacrylate instead of the methyl methacrylate-methacrylic acid copolymer.

Preparation of Dispersions of Microcatsules Containing Dyestuffs

To a solution containing 2 g of exemplary inventive dyestuff D-7 shown above, 24 ml of ethyl acetate and 22 g of Takenade D110N was added 85 ml of an aqueous solution containing 5 g of polyvinyl alcohol. The mixture was emulsified and dispersed by a high-speed agitator (Homogenizer by Nippon Seiki K.K.) at 6,000 rpm for 5 minutes. To the thus obtained emulsified dispersion was added 15 ml of water. The mixture was evenly mixed and agitated at 40° C. for 3 hours, obtaining a microcapsule dispersion C-1.

A microcapsule dispersion C-2 was obtained by the same procedure as dispersion C-1, but using 2 g of exemplary inventive dyestuff D-10 instead of dyestuff D-7.

Example 1

Preparation of Silver Halide Grains

In 700 ml of water were dissolved 22 g of phthalated gelatin and 30 mg of potassium bromide. The solution was adjusted to pH 5.0 at a temperature of 35° C. To the solution, 159 ml of an aqueous solution containing 18.6 g of silver nitrate and 0.9 g of ammonium nitrate and an aqueous solution containing potassium bromide and potassium iodide in a molar ratio of 92:8 were added over 10 minutes by the controlled double jet method while maintaining the solution at pAg 7.7. Then, 476 ml of an aqueous solution containing 55.4 g of silver nitrate and 2 g of ammonium nitrate and an aqueous solution containing 10 μmol/liter of dipotassium hexachloroiridate and 1 mol/liter of potassium bromide were added over 30 minutes by the controlled double jet method while maintaining the solution at pAg 7.7. After 1 g of 4-hydroxy-6-methyl-1,3,3a,7-tetraazaindene was added, the pH tip of the solution was lowered to cause flocculation and sedimentation for desalting. The solution was adjusted to pH 5.9 and pAg 8.2 by adding 0.1 g of phenoxyethanol. There were completed cubic grains of silver iodobromide having an iodide content of 8 mol % in the core and 2 mol % on the average, a mean grain size of 0.05 μm, a coefficient of variation of the projected area of 8%, and a (100) face proportion of 88%.

The thus obtained silver halide grains were heated at 60° C., to which 85 μm mol of sodium thiosulfate, 11 μm mol of 2,3,4,5,6-pentafluorophenyldiphenylphosphine selenide, 3.5 μm mol of chloroauric acid, and 270 μm mol of thiocyanic acid were added per mol of silver. The mixture was ripened for 120 minutes and then quenched to 30° C., obtaining a silver halide emulsion.

Preparation of Organic Acid Silver Emulsion

While 7 g of stearic acid, 4 g of arachidic acid, 36 g of behenic acid, and 850 ml of distilled water were vigorously stirred at 90° C., 187 ml of 1N NaOH aqueous solution was added. Reaction was carried out for 60 minutes. After 65 ml of 1N nitric acid was added, the solution was cooled to 50° C. With more vigorous stirring, 0.62 g of N-bromosuccinimide was added. After 10 minutes, the previously prepared silver halide grains were added so as to give a silver halide content of 6.2 mmol. Further, 125 ml of an aqueous solution containing 21 g of silver nitrate was added over 100 seconds, stirring was continued for 10 minutes, 0.62 g of N-bromosuccinimide was added, and the mixture was allowed to stand for a further 10 minutes. Thereafter, the solids were separated by suction filtration and washed with water until the water filtrate reached a conductivity of 30 μS/cm. To the thus obtained solids, 150 g of a-butyl acetate solution of 0.6 wt % polyvinyl acetate was added, followed by agitation. With agitation interrupted, the solution was allowed to stand whereupon it separated into an oil layer and a water layer. The water layer was removed together with the salts contained therein, leaving the oil layer. Next, 80 g of a 2-butanone solution of 2.5 wt % polyvinyl butyral (Denka Butyral #3000-K by Denki Kagaku Kogyo K.K.) was added to the oil layer, which was agitated. Then 0.1 mmol of pyridinium bromide perbromide and 0.15 mmol of calcium bromide dihydrate were added thereto together with 0.7 g of methanol, and 200 g of 2-butanone and 59 g of polyvinyl butyral (BUTVAR™B-76 by Monsanto Co.) were further added. The mixture was dispersed by means of a homogenizer, obtaining an organic acid silver salt emulsion of needle grains having a mean minor diameter of 0.04 μm, a mean major diameter of 1 μm and a coefficient of variation of 30%.

Preparation of Emulsion Layer Coating Solution

Various chemicals were added to the above-prepared organic acid silver emulsion in amounts per mol of silver. With stirring at 25° C., 10 mg of sodium phenylthiosulfonate, 80 mg of Sensitizing Dye (1) shown below, 2 g of 2-mercapto-5-methylbenzoimidazole, 21.5 g of 4-chlorobenzophenone-2-carboxylic acid, 580 g of 2-butanone, and 220 g of dimethylformamide were added to the emulsion. With stirring, there were further added 2 g of Disulfide Compound (1) shown below, 140 g of 1,1-bis(2-hydroxy-3,5-dimethylphenyl)-3,5,5-trimethylhexane, 1.1 g of Megafax F-176P (fluorinated surfactant by Dai-Nippon Ink & Chemicals K.K.), 590 g of 2-butanone, and 10 g of methyl isobutyl ketone.

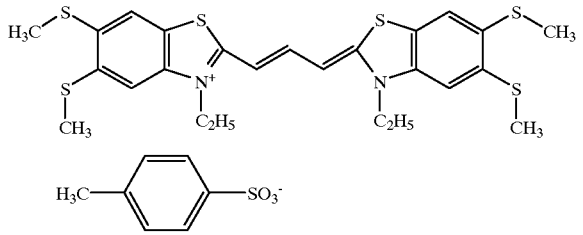

Disulfide Compound (1)

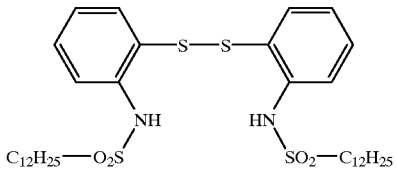

A dyestuff, a dispersion of dyestuff-containing polymeric microparticulates or a dispersion of dyestuff-containing microcapsules, the type and amount of which are shown in Table 1, was added to the solution, obtaining coating solutions. It is noted that Dyestuff (1a) has the structure shown below. The coverage shown in Table 1 is an amount of a dyestuff coated.

Dyestuff (1a)

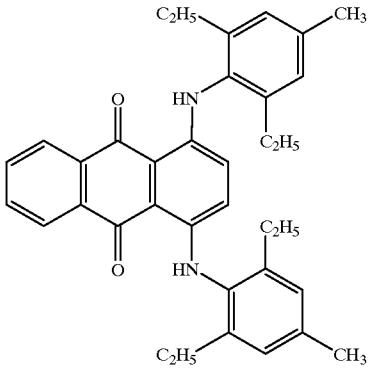

Emulsion Surface Orotective Layer Coating Solution

A coating solution was prepared by dissolving 75 g of CAB 171–15S (cellulose acetate butyrate by Eastman Chemical Products, Inc.), 5.7 g of 4-methylphthalic acid, 1.5 g of tetrachlorophthalic anhydride, 10 g of phthalazine, 5.1 g of tetrachlorophthalic acid, 0.3 g of Megafax F-176P, 2 g of Sildex H31 (true spherical silica with a mean size of 3 $\mu$m, by Dokai Chemical K.K.), and 6 g of Sumidur N3500 (polyisocyanate by Sumitomo-Bayern Urethane K.K.) in 3,000 g of 2-butanone and 30 g of ethyl acetate.

Back Surface Coating Solution

First, a base solution was obtained by dispersing 12 g of tricyclohexyl guanidine as a solid base, 1.6 g of polyvinyl alcohol and 27 g of water in a 1/16G Sand Grinder Mill (by Imex K.K.).

Next, an organic solvent phase was obtained by mixing and dissolving 2 g of Basic Dyestuff Precursor (1) shown below, 2 g of Acidic Compound (1) shown below, 18 g of a 3:1 addition product of xylylene diisocyanate and trimethylol propane, 24 g of dibutyl phthalate and 5 g of ethyl acetate. It was mixed with an aqueous solution phase consisting of 5.2 g of polyvinyl alcohol and 58 g of water, which was emulsified and dispersed at room temperature (mean particle size 2.5 $\mu$m). Water, 100 g, was added to the emulsion, which was heated to 60° C. while stirring. This was allowed to stand for 2 hours, obtaining a colored microcapsule solution.

Basic Dyestuff Precursor (1)

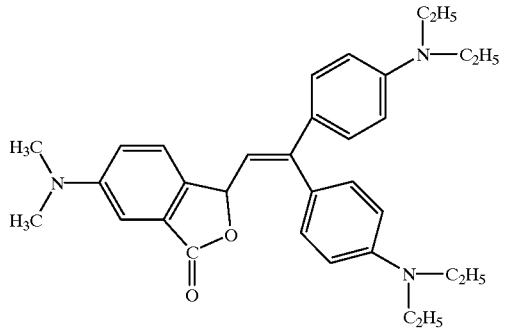

Acidic Compound (1)

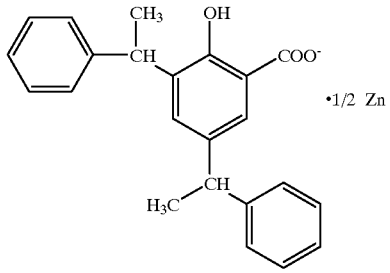

A back surface coating solution was obtained by mixing 20 g of the above-prepared base solution, 20 g of the above-prepared colored microcapsule solution, 21 g of gelatin, 0.6 g of sodium dodecylbenzenesulfonate, and 0.6 g of 1,3-divinylsulfone-2-propanol.

A back surface protective layer coating solution was obtained by dissolving 10 g of gelatin, 0.6 g of polymethyl methacrylate (mean particle size 7 $\mu$m), 0.4 g of sodium dodecylbenzenesulfonate, and 1 g of X-22–2809 (silicone compound by Shin-Etsu Silicone K.K.) in 500 g of water.

Preparation of Dhotothermoaraphic Element

A 175-$\mu$m polyethylene terephthalate support had a moisture-proof subbing layer containing vinylidene chloride on one surface and a gelatin subbing layer on another surface. The emulsion layer coating solution prepared above was coated to the vinylidene chloride subbing layer side of the support so as to give a silver coverage of 2.3 g/m$^2$. Thereafter, on the side opposite to the emulsion layer, the back surface coating solution in such a coverage as to give an optical density of 0.5 at 650 nm and the back surface protective layer coating solution in such an amount to give a dry thickness of 0.9 $\mu$m were simultaneously coated in an overlapping manner. Further, the emulsion surface protective layer coating solution was coated onto the emulsion surface so as to give a dry thickness of 2 $\mu$m. In this way, there were obtained coated samples 1-1 to 1-8 of photothermographic element, which were tested as follows.

Examination of Fog

Without exposure, coated samples 1-1 to 1-8 were subjected to development at 115° C. for 25 seconds and measured for density by the ordinary method. The density of developed sample minus the density of undeveloped sample is shown as ΔFog in Table 1.

Examination of Discoloration by Light Illumination

The coated samples which were developed without exposure as in the examination of photographic properties were illuminated for 24 hours to light (70,000 lux) from a xenon lamp through a UV-cut filter and measured for absorption spectrum. A change of absorbance at the absorption peak wavelength before and after light illumination is shown in Table 1. Table 1 shows the absorption peak density before illumination as D(λmax) (Fresh), the absorption peak density after illumination as D(λmax) (Xe ld), and a percent ratio of the absorption peak density after illumination as D(λmax) (Xe ld) to the absorption peak density before illumination as D(λmax) (Fresh) as Retentivity (%).

TABLE 1

| Sample No. | Dyestuff | Coverage* (mg/m$^2$) | Tone | D (λ max) (Fresh) | D (λ max) (Xe 1d) | Retentivity (%) | ΔFog (115° C./25 sec) |
|---|---|---|---|---|---|---|---|
| 1-1 (comparison) | none | — | pale yellowish brown | — | — | — | 0.04 |
| 1-2 (comparison) | Dyestuff (1a) | 45 | blue | 0.38 | 0.34 | 89 | 0.06 |
| 1-3 (invention) | P-1 | 45 | blue | 0.35 | 0.34 | 97 | 0.05 |
| 1-4 (invention) | P-2 | 50 | royal purple | 0.33 | 0.32 | 97 | 0.04 |
| 1-5 (invention) | P-3 | 60 | green | 0.30 | 0.30 | 100 | 0.05 |
| 1-6 (invention) | P-4 | 45 | blue | 0.34 | 0.33 | 97 | 0.04 |
| 1-7 (invention) | C-1 | 45 | blue | 0.33 | 0.33 | 100 | 0 06 |
| 1-8 (invention) | C-2 | 50 | royal purple | 0.29 | 0.29 | 100 | 0.05 |

*Coverage of dispersion is expressed by the coverage of dyestuff contained therein It is evident that Samples 1-3 to 1-8 within the scope of the invention are improved in light fastness.

Example 2

Coated samples 2-1 to 2-8 were prepared as in Example 1 except that the emulsion layer coating solution was prepared by further adding 5 g of tribromomethylsulfonylbenzene (II-2) before the addition of the disulfide compound.

The thus obtained samples were examined as in Example 1, with the results shown in Table 2.

TABLE 2

| Sample No. | Dyestuff | Coverage* (mg/m$^2$) | D (λ max) (Fresh) | D (λ max) (Xe 1d) | Retentivity (%) | ΔFog (115° C./25 sec) |
|---|---|---|---|---|---|---|
| 2-1 (comparison) | none | — | — | — | — | 0.01 |
| 2-2 (comparison) | Dyestuff (1a) | 45 | 0.38 | 0.09 | 24 | 0.02 |
| 2-3 (invention) | P-1 | 45 | 0.35 | 0.34 | 97 | 0.01 |
| 2-4 (invention) | P-2 | 50 | 0.33 | 0.31 | 94 | 0.02 |
| 2-5 (invention) | P-3 | 60 | 0.30 | 0.28 | 93 | 0.01 |
| 2-6 (invention) | P-4 | 45 | 0.34 | 0.32 | 94 | 0.01 |
| 2-7 (invention) | C-1 | 45 | 0.33 | 0.30 | 91 | 0.02 |
| 2-8 (invention) | C-2 | 50 | 0.29 | 0.28 | 97 | 0.01 |

*Coverage of dispersion is expressed by the coverage of dyestuff contained therein It is evident that more outstanding effects are exerted when a polyhalogenated compound is contained and Samples 2-3 to 2-8 within the scope of the invention are very stable against light illumination.

Example 3

Preparation of Silver Halide Grains A

In 700 ml of water were dissolved 22 g of phthalated gelatin and 30 mg of potassium bromide. The solution was adjusted to pH 5.0 at a temperature of 40° C. To the solution, 159 ml of an aqueous solution containing 18.6 g of silver nitrate and an aqueous solution containing potassium bromide and potassium iodide in a molar ratio of 92:8 were added over 10 minutes by the controlled double jet method while maintaining the solution at pAg 7.7. Then, 476 ml of an aqueous solution containing 55.4 g of silver nitrate and an aqueous solution containing 8 μm mol/liter of dipotassium hexachloroiridate and 1 mol/liter of potassium bromide were added over 30 minutes by the controlled double jet method while maintaining the solution at pAg 7.7. The pH of the solution was lowered to cause flocculation and sedimentation for desalting. The solution was adjusted to pH 5.9 and pAg 8.0 by adding 0.1 g of phenoxyethanol. There were obtained cubic grains having a silver iodide content of 8 mol % in the core and 2 mol % on the average, a grain size of 0.07 μm, a coefficient of variation of projected area diameter of 8%, and a (100) face proportion of 86%.

To the thus obtained silver halide grains A, 1 mol % based on the silver of potassium iodide was added, followed by agitation at 35° C. for 1 hour. After the temperature was raised to 60° C., $7\times10^{-4}$ mol of Sensitizing Dye A shown below and $7\times10^{-4}$ mol of Sensitizing Dye B shown below were added per mol of the silver halide, while stirring.

Thereafter, 85 μm mol of sodium thiosulfate, 11 μm mol of 2,3,4,5,6-pentafluorophenyldiphenylphosphine selenide, 2 μm mol of Tellurium Compound 1 shown below, 3.3 μm mol of chloroauric acid, and 230 μm mol of thiocyanic acid were added per mol of silver. The solution was ripened for 120 minutes and quenched to 30° C., completing the preparation of silver halide grains A.

Sensitizing Dye A

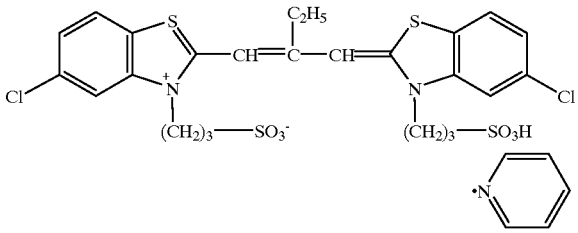

Sensitizing Dye B

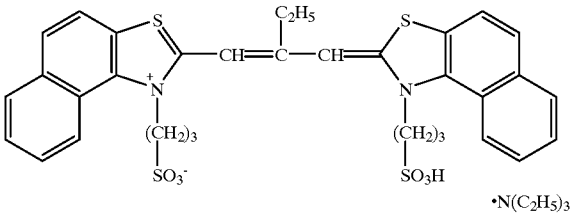

Tellurium Compound 1

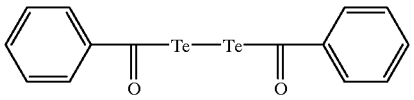

Preparation of Organic Acid Silver Microcrystalline Dispersion

After 40 g of behenic acid, 7.3 g of stearic acid, and 500 ml of water were stirred at 90° C. for 15 minutes, 187 ml of 1N NaOH was added over 15 minutes, 61 ml of 1N nitric acid aqueous solution was added, and the solution was cooled to 50° C. Next, 124 ml of an aqueous solution of 1N silver nitrate was added over 2 minutes and stirring was continued for 30 minutes. Thereafter, the solids were separated by suction filtration and washed with water until the water filtrate reached a conductivity of 30 μS/cm. The thus obtained solids were handled as a wet cake without drying. To 34.8 g as dry solids of the wet cake were added 12 g of polyvinyl alcohol and 150 ml of water. They were thoroughly mixed to form a slurry. A vessel was charged with the slurry together with 840 g of zirconia beads having a mean diameter of 0.5 mm. A dispersing machine (1/4G Sand Grinder Mill by Imex K.K.) was operated for 5 hours for dispersion, completing the preparation of an organic acid silver microcrystalline dispersion of needle grains having a mean minor diameter of 0.04 μm, a mean major diameter of 0.8 μm and a coefficient of variation of projected area of 30% as observed under an electron microscope.

Solid Particle Dispersions of Chemical Addenda

Solid particle dispersions of tetrachlorophthalic acid, 4-methylphthalic acid, 1,1-bis(2-hydroxy-3,5-dimethylphenyl-)-3,5,5-trimethylhexane, phthalazine, and tribromomethylphenylsulfone (II-2) were prepared. To tetrachlorophthalic acid were added 0.81 g of hydroxypropyl methyl cellulose and 94.2 ml of water. They were thoroughly agitated to form a slurry, which was allowed to stand for 10 hours. A vessel was charged with the slurry together with 100 ml of zirconia beads having a mean diameter of 0.5 mm. A dispersing machine as used in the preparation of the organic acid silver microcrystalline dispersion was operated for 5 hours for dispersion, obtaining a solid particle dispersion of tetrachlorophthalic acid in which particles with a diameter of up to 1.0 μm accounted for 70% by weight. Solid particle dispersions of the remaining chemical addenda were similarly prepared by properly changing the amount of dispersant and the dispersion time to achieve a desired mean particle size.

Preparation of Emulsion Layer Coating Solution

To the organic silver microcrystalline dispersion (equivalent to 1 mol of silver) were added the silver halide grains A in an amount corresponding to 10 mol % based on the organic acid silver of silver halide, 5 g of tetrachlorophthalic acid, 98 g of 1,1-bis(2-hydroxy-3,5-dimethylphenyl)-3,5,5-trimethylhexane, 9.2 g of phthalazine, 12 g of tribromomethylsulfonylbenzene, a dyestuff, a dispersion of dyestuff-containing polymeric microparticulates or a dispersion of dyestuff-containing microcapsules, the type and amount of which are shown in Table 3, and 108 g of Lacstar 3307B (SBR latex by Dai-Nippon Ink & Chemicals K.K.) as a polymer latex. There was obtained an emulsion layer coating solution. It is noted that Dyestuff (1) in Table 3 is the same as used in Example 1. Lacstar 3307B is a polymer latex containing a styrene-butadiene copolymer wherein the dispersed particles have a mean particle diameter of 0.1 to 0.15 μm.

Preparation of Emulsion Surface Protective Layer Coating Solution

A surface protective layer was prepared by adding 0.26 g of Surfactant A shown below, 0.09 g of Surfactant B shown below, 0.9 g of silica microparticulates having a mean particle size of 2.5 μm, 0.3 g of 1,2-bis(vinylsulfonylacetamide)ethane and 64 g of water to 10 g of inert gelatin.

Surfactant A

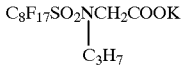

Surfactant B

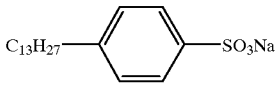

Preparation of Color Developing Agent Dispersion

To 35 g of ethyl acetate were added 2.5 g of Compound 1 and 7.5 g of Compound 2, both shown below. The mixture was agitated for dissolution. The solution was combined with 50 g of a 10 wt % polyvinyl alcohol solution and agitated for 5 minutes by means of a homogenizer. Thereafter, the ethyl acetate was volatilized off for solvent removal purpose. Dilution with water yielded a color developing agent dispersion.

Compound 1

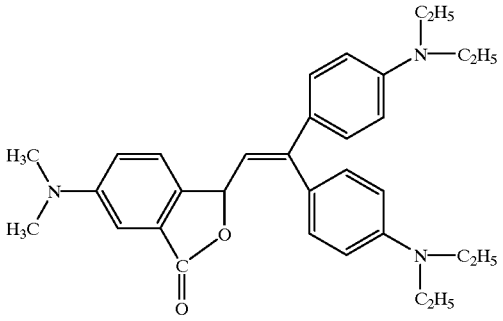

Compound 2

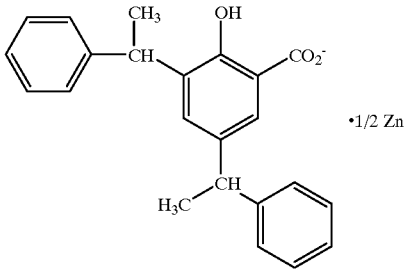

-continued

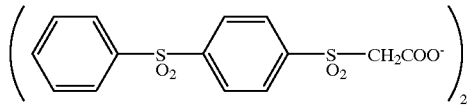

Preparation of Emulsion Layer Coated Sample

The emulsion layer coating solution prepared above was coated to a transparent 175-$\mu$m polyethylene terephthalate support so as to give a silver coverage of 1.9 g/m$^2$. Thereafter, the emulsion surface protective layer coating solution was coated onto the emulsion coating layer so as to give a gelatin coverage of 1.8 g/m$^2$. After drying, the back surface coating solution was coated on the surface of the support opposite to the emulsion layer so as to provide an optical density of 0.5 at 660 nm, obtaining Samples 3-1 to 3-8.

The thus obtained samples were examined as in Example 1, with the results shown in Table 3.

TABLE 3

| Sample No. | Dyestuff | Coverage* (mg/m$^2$) | Tone | D (λ max) (Fresh) | D (λ max) (Xe 1d) | Retentivity (%) | ΔFog (115° C./25 sec) |
|---|---|---|---|---|---|---|---|
| 3-1 (comparison) | none | — | pale yellowish brown | — | — | — | 0.02 |
| 3-2 (comparison) | Dyestuff (1a) | 45 | blue | 0.38 | 0.06 | 16 | 0.04 |
| 3-3 (invention) | P-1 | 45 | blue | 0.35 | 0.29 | 83 | 0.03 |
| 3-4 (invention) | P-2 | 50 | royal purple | 0.33 | 0.25 | 76 | 0.02 |
| 3-5 (invention) | P-3 | 60 | green | 0.30 | 0.28 | 93 | 0.02 |
| 3-6 (invention) | P-4 | 45 | blue | 0.34 | 0.31 | 91 | 0.03 |
| 3-7 (invention) | C-1 | 45 | blue | 0.33 | 0.31 | 94 | 0.02 |
| 3-8 (invention) | C-2 | 50 | royal purple | 0.29 | 0.27 | 93 | 0.03 |

*Coverage of dispersion is expressed by the coverage of dyestuff contained therein Preparation of Back Surface Coating Solution A back surface coating solution was prepared by adding 35 g of the color developing agent dispersion prepared above, 20 g of the compound shown below, 250 g of water, and 1.8 g of Sildex.H121 (true spherical silica having a mean size of 12 $\mu$m, Dokai Chemical K.K.) to 30 g of polyvinyl alcohol.

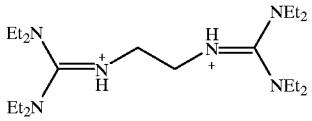

It is evident that more outstanding effects are accomplished and Samples 3-3 to 3-8 within the scope of the invention are fully stable against light illumination.

Example 4

Preparation of Organic Acid Silver Emulsion

To 12 liters of water were added 840 g of behenic acid and 95 g of stearic acid. To the solution kept at 90° C., a solution of 48 g of sodium hydroxide and 63 g of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 g of a butyl acetate solution of 1.2 wt % polyvinyl acetate was added to the aqueous mixture. The mixture was allowed to stand for 10 minutes, separating into two layers. After the aqueous layer was removed, the remaining gel was washed two times with water. There was obtained a gel-like mixture of silver behenate/stearate and silver bromide, which was dispersed in 1,800 g of an isopropyl alcohol solution of 2.6% polyvinyl butyral (Denka Butyral #3000-K by Denki Kagaku Kogyo K.K.). The dispersion was further dispersed in 600 g of polyvinyl butyral (Denka Butyral #4000-2 by Denki Kagaku Kogyo K.K.) and 300 g of isopropyl alcohol, obtaining an organic acid silver salt emulsion of needle grains having a mean minor diameter of 0.05 μm, a mean major diameter of 1.2 μm, and a coefficient of variation of 25%.

Preparation of Emulsion Layer Coating Solution

Various chemicals were added to the above-prepared organic acid silver emulsion in amounts per mol of silver. With stirring at 25° C., 10 mg of sodium phenylthiosulfonate, 50 mg of Sensitizing Dye C, 2 g of 2-mercapto-5-methylbenzimidazole, 21.5 g of 4-chlorobenzophenone-2-carboxylic acid, 580 g of 2-butanone, and 220 g of dimethylformamide were added to the emulsion, which was allowed to stand for 3 hours. With stirring, there were further added 8 g of 5-tribromomethylsulfonyl-2-methylthiadiazole (II-12), 2 g of Disulfide Compound (1), 140 g of 1,1-bis(2-hydroxy-3,5-dimethylphenyl)-3,5,5-trimethylhexane, 5 g of tetrachlorophthalic acid, 2.1 g of Hydrazine Compound A, 1.1 g of Megafax F-176P (fluorinated surfactant by Dai-Nippon Ink & Chemicals K.K.), a dyestuff, a dispersion of dyestuff-containing polymeric microparticulates or a dispersion of dyestuff-containing microcapsules, the type and amount of which are shown in Table 4, 590 g of 2-butanone and 10 g of methyl isobutyl ketone. It is noted that Dyestuff (1a) in Table 4 is the same as used in Example 1.

Emulsion Surface Protective Layer Coating Solution

A coating solution was prepared by dissolving 75 g of CAB 171–15S (cellulose acetate butyrate by Eastman Chemical Products, Inc.), 5.7 g of 4-methylphthalic acid, 1.5 g of tetrachlorophthalic anhydride, 12 g of phthalazine, 0.3 g of Megafax F-176P, 2 g of Sildex H31 (true spherical silica having a mean size of 3 μm, by Dokai Chemical K.K.), and 5 g of Sumidur N3500 (polyisocyanate by Sumitomo-Bayern Urethane K.K.) in 3,070 g of 2-butanone and 30 g of ethyl acetate.

Preparation of Back Coated Support

A coating solution was prepared by adding 6 g of polyvinyl butyral (Denka Butyral #4000-2 by Denki Kagaku Kogyo K.K.), 0.2 g of Sildex H121 (true spherical silica having a mean size 12 μm, by Dokai Chemical K.K.), 0.2 g of Sildex H51 (true spherical silica having a mean size 5 μm, by Dokai Chemical K.K.), and 0.1 g of Megafax F-176P to 64 g of 2-propanol and stirring the mixture for dissolving the components. Further added to the solution were a solution containing 420 mg of Dyestuff (3) in 10 g of methanol and 20 g of acetone and a solution containing 1 g of 3-isocyanato-methyl-3,5,5-trimethylhexyl isocyanate in 7 g of ethyl acetate.

Onto a polyethylene terephthalate film having moisture-proof subbing layers of vinylidene chloride on opposite surfaces, the back layer coating solution was coated so as to provide an optical density of 0.7 at 633 nm.

The compounds used herein are of the structural formulae shown below, and Dyestuff (1a) is the same as used in Example 1.

Sensitizing Dye C

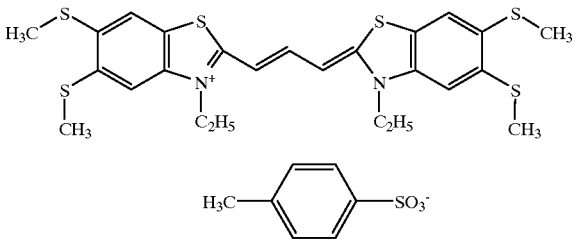

Disulfide Compound (1)

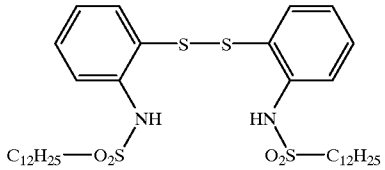

Hydrazine Compound A

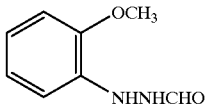

Dyestuff (3)

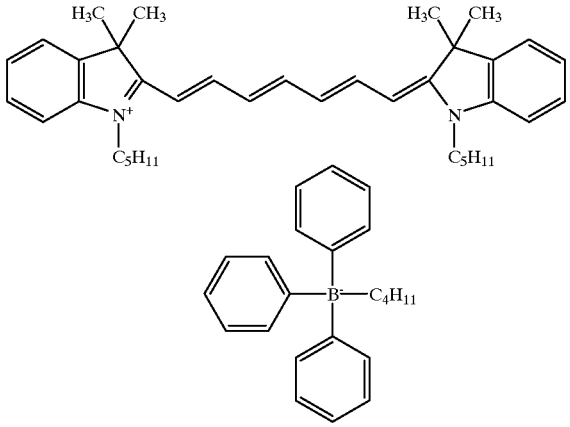

Preparation of Emulsion Layer-coated Sample

The emulsion layer coating solution was coated to the support prepared above so as to provide a silver coverage of 2 g/m$^2$. The emulsion surface protective layer coating solution was coated onto the emulsion layer to a dry thickness of 2 μm, obtaining Samples 4-1 to 4-8.

The thus obtained samples were examined as in Example 1, with the results shown in Table 4.

TABLE 4

| Sample No. | Dyestuff | Coverage* ($mg/m^2$) | D (λ max) (Fresh) | D (λ max) (Xe 1d) | Retentivity (%) | ΔFog (115° C./25 sec) |
|---|---|---|---|---|---|---|
| 4-1 (comparison) | none | — | — | — | — | 0.02 |
| 4-2 (comparison) | Dyestuff (1a) | 45 | 0.37 | 0.08 | 22 | 0.03 |
| 4-3 (invention) | P-1 | 45 | 0.35 | 0.33 | 94 | 0.03 |
| 4-4 (invention) | P-2 | 50 | 0.33 | 0.30 | 91 | 0.03 |
| 4-5 (invention) | P-3 | 60 | 0.30 | 0.28 | 93 | 0.02 |
| 4-6 (invention) | P-4 | 45 | 0.34 | 0.31 | 91 | 0.02 |
| 4-7 (invention) | C-1 | 45 | 0.33 | 0.32 | 97 | 0.03 |
| 4-8 (invention) | C-2 | 50 | 0.29 | 0.27 | 93 | 0.02 |

*Coverage of dispersion is expressed by the coverage of dyestuff contained therein It is evident that outstanding effects are accomplished and Samples 4-3 to 4-8 within the scope of the invention are fully stable against light illumination.

Example 5

Preparation of Silver Halide Trains

In 700 ml of water were dissolved 22 g of phthalated gelatin and 30 mg of potassium bromide. The solution was adjusted to pH 5.0 at a temperature of 35° C. To the solution, 159 ml of an aqueous solution containing 18.6 g of silver nitrate and 0.9 g of ammonium nitrate and an aqueous solution containing potassium bromide and potassium iodide in a molar ratio of 92:8 were added over 10 minutes by the controlled double jet method while maintaining the solution at pAg 7.7. Then, 476 ml of an aqueous solution containing 55.4 g of silver nitrate and 2 g of ammonium nitrate and an aqueous solution containing 10 μmol/liter of dipotassium hexachloroiridate and 1 mol/liter of potassium bromide were added over 30 minutes by the controlled double jet method while maintaining the solution at pAg 7.7. After 1 g of 4-hydroxy-6-methyl-1,3,3a,7-tetraazaindene was added, the pH of the solution was lowered to cause flocculation and sedimentation for desalting. The solution was adjusted to pH 5.9 and pAg 8.2 by adding 0.1 g of phenoxyethanol. There were completed cubic grains of silver iodobromide having an iodide content of 8 mol % in the core and 2 mol % on the average, a mean grain size of 0.05 μm. a coefficient of variation of the projected area of 8%, and a (100) face proportion of 88%.

The thus obtained silver halide grains were heated at 60° C., to which 85 μmol of sodium thiosulfate, 11 μmol of 2,3,4,5,6-pentafluorophenyldiphenylphosphine selenide, 3.5 μmol of chloroauric acid, and 270 μmol of thiocyanic acid were added per mol of silver. The mixture was ripened for 120 minutes and then quenched to 30° C., obtaining a silver halide emulsion.

Preparation of Organic Acid Silver Emulsion

While 7 g of stearic acid, 4 g of arachidic acid, 36 g of behenic acid, and 850 ml of distilled water were vigorously stirred at 90° C., 187 ml of 1N NaOH aqueous solution was added. Reaction was carried out for 60 minutes. After 65 ml of 1N nitric acid was added, the solution was cooled to 50° C. With more vigorous stirring, 0.62 g of N-bromosuccinimide was added. After 10 minutes, the previously prepared silver halide grains were added so as to give a silver halide content of 6.2 mmol. Further, 125 ml of an aqueous solution containing 21 g of silver nitrate was added over 100 seconds, stirring was continued for 10-minutes, 0.62 g of N-bromosuccinimide was added, and the mixture was allowed to stand for a further 10 minutes. Thereafter, the solids were separated by suction filtration and washed with water until the water filtrate reached a conductivity of 30 μS/cm. To the thus obtained solids, 150 g of a butyl acetate solution of 0.6 wt % polyvinyl acetate was added, followed by agitation. With agitation interrupted, the solution was allowed to stand whereupon it separated into an oil layer and a water layer. The water layer was removed together with the salts contained therein, leaving the oil layer. Next, 80 g of a 2-butanone solution go of 2.5 wt % polyvinyl butyral (Denka Butyral #3000-K by Denki Kagaku Kogyo K.K.) was added to the oil layer, which was agitated. Then 0.1 mmol of pyridinium bromide perbromide and 0.15 mmol of calcium bromide dihydrate were added thereto together with 0.7 g of methanol, and 200 g of 2-butanone and 59 g of polyvinyl butyral (BUTVAR™ B-76 by Monsanto Co.) were further added. The mixture was dispersed by means of a homogenizer, obtaining an organic acid silver salt emulsion of needle grains having a mean minor diameter of 0.04 μm, a mean major diameter of 1 μm and a coefficient of variation of 30%.

Preparation of Emulsion Layer Coating Solution

Various chemicals were added to the above-prepared rganic acid silver emulsion in amounts per mol of silver. With stirring at 25° C., 10 mg of sodium phenylthiosulfonate, 80 mg of Sensitizing Dye (1) shown below, 2 g of 2-mercapto-5-methylbenzoimidazole, 21.5 g of 4-chlorobenzophenone-2-carboxylic acid, 580 g of 2-butanone, and 220 g of dimethylformamide were added to the emulsion. With stirring, there were further added 2 g of Disulfide Compound (1) shown below, 140 g of 1,1-bis(2-hydroxy-3,5-dimethyl-phenyl)-3,5,5-trimethylhexane, 1.1 g of Megafax F-176P (fluorinated surfactant by Dai-Nippon Ink & Chemicals K.K.), 590 g of 2-butanone, and 10 g of methyl isobutyl ketone. A dyestuff or pigment, the type and amount of which are shown in Table 1, was added thereto, obtaining coating solutions. It is noted that Dyestuffs (1) and (2) are of the structure shown below.

Sensitizing Dye (1)

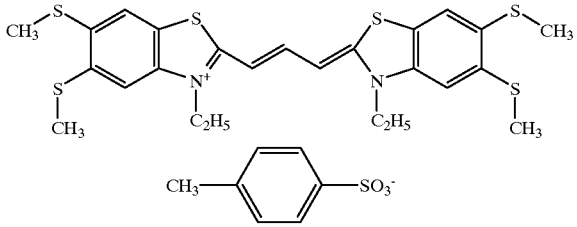

Disulfide Compound (1)

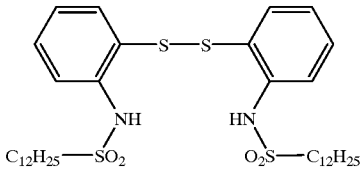

Dyestuff (1b)

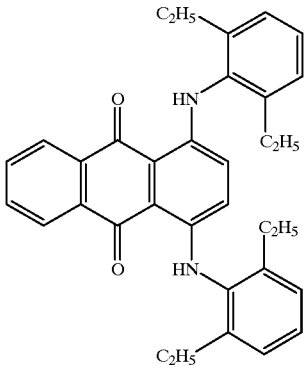

Dyestuff (2)

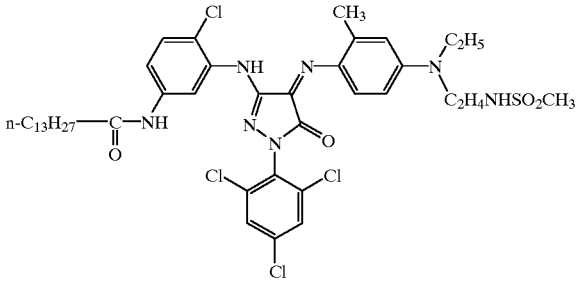

Emulsion Surface Protective Layer Coating Solution

A coating solution was prepared by dissolving 75 g of CAB 171–15S (cellulose acetate butyrate by Eastman Chemical Products, Inc.), 5.7 g of 4-methylphthalic acid, 1.5 g of tetrachlorophthalic anhydride, 10 g of phthalazine, 5.1 g of tetrachlorophthalic acid, 0.3 g of Megafax F-176P, 2 g of Sildex H31 (true spherical silica with a mean size of 3 $\mu$m, by Dokai Chemical K.K.), and 6 g of Sumidur N3500 (polyisocyanate by Sumitomo-Bayern Urethane K.K.) in 3,000 g of 2-butanone and 30 g of ethyl acetate.

Back Surface Coating Solution

First, a base solution was obtained by dispersing 12 g of tricyclohexyl guanidine as a solid base, 1.6 g of polyvinyl alcohol and 27 g of water in a 1/16G Sand Grinder Mill (by Imex K.K.).

Next, an organic solvent phase was obtained by mixing and dissolving 2 g of Basic Dyestuff Precursor (1) shown below, 2 g of Acidic Compound (1) shown below, 18 g of a 3:1 addition product of xylylene diisocyanate and trimethylol propane, 24 g of dibutyl phthalate and 5 g of ethyl acetate. It was mixed with an aqueous solution phase consisting of 5.2 g of polyvinyl alcohol and 58 g of water, which was emulsified and dispersed at room temperature (mean particle size 2.5 $\mu$m). Water, 100 g, was added to the emulsified solution, which was heated to 60° C. while stirring. This was allowed to stand for 2 hours, obtaining a colored microcapsule solution.

Basic Dyestuff Precursor (1)

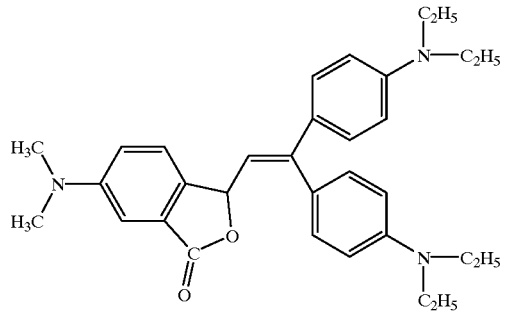

Acidic Compound (1)

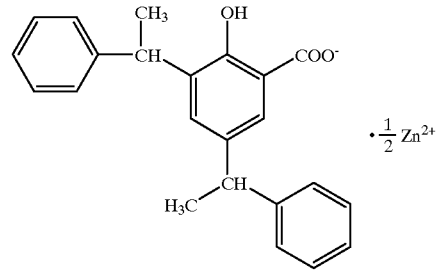

A back surface coating solution was obtained by mixing 20 g of the above-prepared base solution, 20 g of the above-prepared colored microcapsule solution, 21 g of gelatin, 0.6 g of sodium dodecylbenzenesulfonate, and 0.6 g of 1,3-divinylsulfone-2-propanol.

A back surface protective layer coating solution was obtained by dissolving 10 g of gelatin, 0.6 g of polymethyl methacrylate (mean particle size 7 $\mu$m), 0.4 g of sodium dodecylbenzenesulfonate, and 1 g of X-22–2809 (silicone compound by Shin-Etsu Silicone K.K.) in 500 g of water.

Preparation of Photothermoaraphic Element

A 175-$\mu$m polyethylene terephthalate support had a moisture-proof subbing layer containing vinylidene chloride on one surface and a gelatin subbing layer on another surface. The emulsion layer coating solution prepared above was coated to the vinylidene chloride subbing layer side of the support so as to give a silver coverage of 2.3 g/m$^2$. Thereafter, on the side opposite to the emulsion layer, the back surface coating solution in such a coverage as to give an optical density of 0.5 at 650 nm and the back surface protective layer coating solution in such an amount to give a dry thickness of 0.9 $\mu$m were simultaneously coated in an overlapping manner. Further, the emulsion surface protective layer coating solution was coated onto the emulsion surface so as to give a dry thickness of 2 $\mu$m.

In this way, there were obtained coated samples 5-1 to 5-9 of photothermographic element, which were tested as follows.

Examination of Fog

Without exposure, coated samples 5-1 to 5-9 were subjected to development at 115° C. for 25 seconds and measured for density by the ordinary method. The density of developed sample minus the density of undeveloped sample is shown as ΔFog in Table 5.

Examination of Discoloration by Light Illumination

The coated samples which were developed without exposure as in the examination of photographic properties were illuminated for 24 hours to light (70,000 lux) from a xenon lamp through a UV-cut filter and measured for absorption spectrum. A change of absorbance at the absorption peak wavelength before and after light illumination is shown in Table 5. Table 5 shows the absorption peak density before illumination as D(λmax) (Fresh), the absorption peak density after illumination as D(λmax) (Xe ld), and a percent ratio of the absorption peak density after illumination as D(λmax) (Xe ld) to the absorption peak density before illumination as D(λmax) (Fresh) as Retentivity (%).

It is evident that Samples 5-4 to 5-9 within the scope of the invention are improved in light fastness.

TABLE 5

| Sample No. | Dyestuff/pigment | Coverage (mg/m$^2$) | λ max | Tone | D (λ max) (Fresh) | D (λ max) (Xe 1d) | Retentivity (%) | ΔFog (115° C./25 sec) |
|---|---|---|---|---|---|---|---|---|
| 5-1 (comparison) | none | — | — | pale yellowish brown | — | — | — | 0.04 |
| 5-2 (comparison) | Dyestuff (1b) | 45 | 648 | blue | 0.38 | 0.34 | 89 | 0.06 |
| 5-3 (comparison) | Dyestuff (2) | 45 | 628 | royal purple | 0.31 | 0.29 | 94 | 0.04 |
| 5-4 (invention) | C. I. Pigment Blue 60 | 75 | 617 | blue | 0.36 | 0.36 | 100 | 0.06 |
| 5-5 (invention) | C. I. Pigment Blue 64 | 75 | 619 | royal purple | 0.30 | 0.30 | 100 | 0.05 |
| 5-6 (invention) | C. I. Pigment Blue 15:6 | 75 | 609 | blue | 0.36 | 0.36 | 100 | 0.04 |
| 5-7 (invention) | C. I. Pigment Blue 16 | 75 | 727 | cyan | 0.40 | 0.40 | 100 | 0.04 |
| 5-8 (invention) | C. I. Pigment Violet 37 | 64 | 564 | purple | 0.30 | 0.30 | 100 | 0.06 |
| 5-9 (invention) | C. I. Pigment Red 202 | 64 | 581 | red | 0.29 | 0.29 | 100 | 0.05 |

Example 6

Coated samples 6-1 to 6-9 were prepared as in Example 5 except that the emulsion layer coating solution was prepared by further adding 5 g of tribromomethylsulfonylbenzene (II-2) before the addition of the disulfide compound.

The samples were examined as in Example 5, with the results shown in Table 6.

TABLE 6

| Sample No. | Dyestuff/pigment | coverage (mg/m$^2$) | D (λ max) (Fresh) | D (λ max) (Xe 1d) | Retentivity (%) | ΔFog (115° C./25 sec) |
|---|---|---|---|---|---|---|
| 6-1 (comparison) | none | — | — | — | — | 0.01 |
| 6-2 (comparison) | Dyestuff (1b) | 45 | 0.38 | 0.09 | 24 | 0.02 |
| 6-3 (comparison) | Dyestuff (2) | 45 | 0.31 | 0.16 | 52 | 0.01 |
| 6-4 (invention) | C. I. Pigment Blue 60 | 75 | 0.36 | 0.34 | 94 | 0.02 |
| 6-5 (invention) | C. I. Pigment Blue 64 | 75 | 0.30 | 0.28 | 93 | 0.01 |
| 6-6 (invention) | C. I. Pigment Blue 15:6 | 75 | 0.36 | 0.36 | 100 | 0.01 |
| 6-7 (invention) | C. I. Pigment Blue 16 | 75 | 0.40 | 0.38 | 95 | 0.01 |
| 6-8 (invention) | C. I. Pigment Violet 37 | 64 | 0.30 | 0.30 | 100 | 0.00 |
| 6-9 (invention) | C. I. Pigment Red 202 | 64 | 0.29 | 0.29 | 100 | 0.01 |

It is evident that more outstanding effects are exerted in this example and Samples 6-4 to 6-9 within the scope of the invention are very stable against light illumination.

Example 7

Preparation of Silver Halide Grains A

In 700 ml of water were dissolved 22 g of phthalated gelatin and 30 mg of potassium bromide. The solution was adjusted to pH 5.0 at a temperature of 40° C. To the solution, 159 ml of an aqueous solution containing 18.6 g of silver nitrate and an aqueous solution containing potassium bromide and potassium iodide in a molar ratio of 92:8 were added over 10 minutes by the controlled double jet method while maintaining the solution at pAg 7.7. Then, 476 ml of an aqueous solution containing 55.4 g of silver nitrate and an aqueous solution containing 8 μmol/liter of dipotassium hexachloroiridate and 1 mol/liter of potassium bromide were added over 30 minutes by the controlled double jet method while maintaining the solution at pAg 7.7. The pH of the solution was lowered to cause flocculation and sedimentation for desalting. The solution was adjusted to pH 5.9 and pAg 8.0 by adding 0.1 g of phenoxyethanol. There were obtained cubic grains having a silver iodide content of 8 mol % in the core and 2 mol % on the average, a grain size of 0.07 μm, a coefficient of variation of projected area diameter of 8%, and a (100) face proportion of 86%.

To the thus obtained silver halide grains A, 1 mol % based on the silver of potassium iodide was added, followed by agitation at 35° C. for 1 hour. After the temperature was raised to 60° C., $7\times10^{-4}$ mol of Sensitizing Dye A shown below and $7\times10^{-4}$ mol of Sensitizing Dye B shown below were added per mol of the silver halide, while stirring. Thereafter, 85 μmol of sodium thiosulfate, 11 μmol of 2,3,4,5,6-pentafluorophenyldiphenylphosphine selenide, 2 μmol of Tellurium Compound 1 shown below, 3.3 μmol of chloroauric acid, and 230 μmol of thiocyanic acid were added per mol of silver. The solution was ripened for 120 minutes and quenched to 30° C., completing the preparation of silver halide grains A.

Sensitizing Dye A

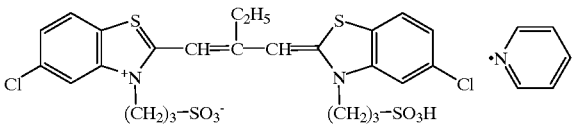

Sensitizing Dye B

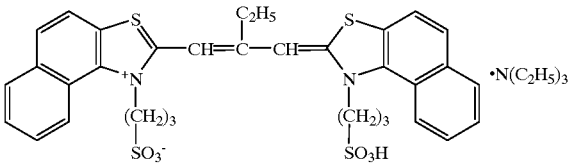

Tellurium Compound 1

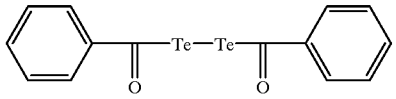

Preparation of Oraanic Acid Silver Microcrystalline Dispersion

After 40 g of behenic acid, 7.3 g of stearic acid, and 500 ml of water were stirred at 90° C. for 15 minutes, 187 ml of 1N NaOH was added over 15 minutes, 61 ml of 1N nitric acid aqueous solution was added, and the solution was cooled to 50° C. Next, 124 ml of an aqueous solution of 1N silver nitrate was added over 2 minutes and stirring was continued for 30 minutes. Thereafter, the solids were separated by suction filtration and washed with water until the water filtrate reached a conductivity of 30 μS/cm. The thus obtained solids were handled as a wet cake without drying. To 34.8 g as dry solids of the wet cake were added 12 g of polyvinyl alcohol and 150 ml of water. They were thoroughly mixed to form a slurry. A vessel was charged with the slurry together with 840 g of zirconia beads having a mean diameter of 0.5 mm. A dispersing machine (1/4G Sand Grinder Mill by Imex K.K.) was operated for 5 hours for dispersion, completing the preparation of an organic acid silver microcrystalline dispersion of needle grains having a mean minor diameter of 0.04 μm, a mean major diameter of 0.8 μm and a coefficient of variation of projected area of 30% as observed under an electron microscope.

Solid Particle Dispersions of Chemical Addenda

Solid particle dispersions of tetrachlorophthalic acid, 4-methylphthalic acid, 1,1-bis(2-hydroxy-3,5-dimethylphenyl)-3,5,5-trimethylhexane, phthalazine, and tribromomethylphenylsulfone (II-2) were prepared. To tetrachlorophthalic acid were added 0.81 g of hydroxypropyl methyl cellulose and 94.2 ml of water. They were thoroughly agitated to form a slurry, which was allowed to stand for 10 hours. A vessel was charged with the slurry together with 100 ml of zirconia beads having a mean diameter of 0.5 mm. A dispersing machine as used in the preparation of the organic acid silver microcrystalline dispersion was operated for 5 hours for dispersion, obtaining a solid particle dispersion of tetrachlorophthalic acid in which particles with a diameter of up to 1.0 μm accounted for 70% by weight. Solid particle dispersions of the remaining chemical addenda were similarly prepared by properly changing the amount of dispersant and the dispersion time to achieve a desired mean particle size.

Preparation of Emulsion Layer Coating Solution

An emulsion layer coating solution was prepared by adding the silver halide grains A in an amount corresponding to 10 mol % based on the organic acid silver of silver halide and the following polymer latex and chemical addenda to the above-prepared organic silver microcrystalline dispersion (equivalent to 1 mol of silver).

| | |
|---|---|
| Lacstar 3307B<br>(SBR latex by Dai-Nippon Ink & Chemicals K.K.) | 108 g |
| Tetrachlorophthalic acid | 5 g |

-continued

| | |
|---|---|
| 1,1-bis(2-hydroxy-3,5-dimethylphenyl)-3,5,5-trimethylhexane | 98 g |
| Phthalazine | 9.2 g |
| Tribromomethylsulfonylbenzene | 12 g |

It is noted that Lacstar 3307B is a polymer latex containing a styrene-butadiene copolymer wherein the dispersed particles have a mean particle diameter of 0.1 to 0.15 μm.

Preparation of Emulsion Surface Protective Layer Coating Solution

A surface protective layer was prepared by adding 0.26 g of Surfactant A shown below, 0.09 g of Surfactant B shown below, 0.9 g of silica microparticulates having a mean particle size of 2.5 μm, 0.3 g of 1,2-bis(vinylsulfonylacetamide)ethane and 64 g of water to 10 g of inert gelatin.

Surfactant A

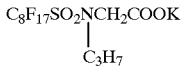

Surfactant B

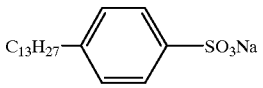

Preparation of Color Developing Agent Dispersion

To 35 g of ethyl acetate were added 2.5 g of Compound 1 and 7.5 g of Compound 2, both shown below. The mixture was agitated for dissolution. The solution was combined with 50 g of a 10 wt % polyvinyl alcohol solution and agitated for 5 minutes by means of a homogenizer. Thereafter, the ethyl acetate was volatilized off for solvent removal purpose. Dilution with water yielded a color developing agent dispersion.

Compound 1

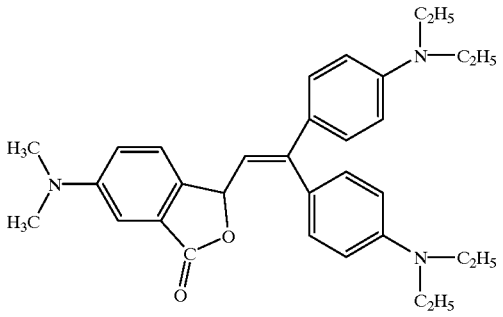

Compound 2

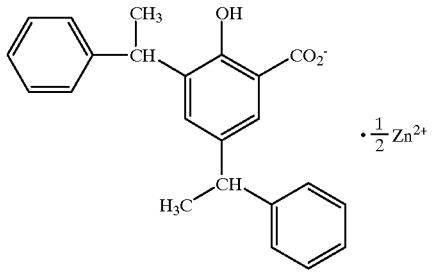

A back surface coating solution was prepared by adding 35 g of the color developing agent dispersion prepared above, 20 g of the compound shown below, 250 g of water, and 10 1.8 g of Sildex H121 (true spherical silica having a mean size of 12 μm, Dokai Chemical K.K.) to 30 g of polyvinyl alcohol.

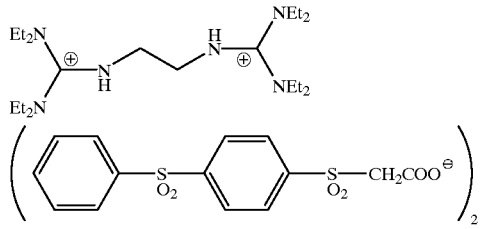

Preparation of Emulsion Layer Coated Sample

The emulsion layer coating solution prepared above was coated to a transparent 175-μm polyethylene terephthalate support so as to give a silver coverage of 1.9 g/m$^2$. Thereafter, the emulsion surface protective layer coating solution was coated onto the emulsion coating layer so as to give a gelatin coverage of 1.8 g/m$^2$. After drying, the back surface coating solution was coated on the surface of the support opposite to the emulsion layer so as to provide an optical density of 0.5 at 660 nm, obtaining Samples 7-1 to 7-9.

The thus obtained samples were examined as in Example 5, with the results shown in Table 7.

TABLE 7

| Sample No. | Dyestuff/pigment | coverage (mg/m$^2$) | λ max | Tone | D (λ max) (Fresh) | D (λ max) (Xe 1d) | Retentivity (%) | ΔFog (115° C./25 sec) |
|---|---|---|---|---|---|---|---|---|
| 7-1 (comparison) | none | — | — | pale yellowish brown | — | — | — | 0.02 |
| 7-2 (comparison) | Dyestuff (1b) | 45 | 656 | blue | 0.37 | 0.07 | 19 | 0.04 |
| 7-3 (comparison) | Dyestuff (2) | 45 | 632 | royal purple | 0.35 | 0.14 | 40 | 0.03 |
| 7-4 (invention) | C. I. Pigment Blue 64 | 75 | 622 | royal purple | 0.30 | 0.29 | 97 | 0.03 |
| 7-5 (invention) | C. I. Pigment Blue 15:6 | 75 | 612 | blue | 0.25 | 0.25 | 100 | 0.02 |
| 7-6 (invention) | C. I. Pigment Blue 15:2 | 75 | 613 | blue | 0.21 | 0.19 | 90 | 0.02 |
| 7-7 (invention) | C. I. Pigment Blue 15:4 | 75 | 715 | cyan | 0.24 | 0.24 | 100 | 0.03 |
| 7-8 (invention) | C. I. Pigment Violet 37 | 64 | 573 | purple | 0.22 | 0.22 | 100 | 0.02 |
| 7-9 (invention) | C. I. Pigment Red 122 | 64 | 564 | pink | 0.23 | 0.23 | 100 | 0.03 |

It is evident that more outstanding effects are accomplished and Samples 7-4 to 7-9 within the scope of the invention are fully stable against light illumination.

Example 8

Preparation of Organic Acid Silver Emulsion

To 12 liters of water were added 840 g of behenic acid and 95 g of stearic acid. To the solution kept at 90° C., a solution of 48 g of sodium hydroxide and 63 g of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 g of a butyl acetate solution of 1.2 wt % polyvinyl acetate was added to the aqueous mixture. The mixture was allowed to stand for 10 minutes, separating into two layers. After the aqueous layer was removed, the remaining gel was washed two times with water. There was obtained a gel-like mixture of silver behenate/stearate and silver bromide, which was dispersed in 1,800 g of an isopropyl alcohol solution of 2.6% polyvinyl butyral (Denka Butyral #3000-K by Denki Kagaku Kogyo K.K.). The dispersion was further dispersed in 600 g of polyvinyl butyral (Denka Butyral #4000-2 by Denki Kagaku Kogyo K.K.) and 300 g of isopropyl alcohol, obtaining an organic acid silver salt emulsion of needle grains having a mean minor diameter of 0.05 μm, a mean major diameter of 1.2 μm, and a coefficient of variation of 25%.

Preparation of Emulsion Layer Coating Solution

Various chemicals were added to the above-prepared organic acid silver emulsion in amounts per mol of silver. With stirring at 25° C., 10 mg of sodium phenylthiosulfonate, 50 mg of Sensitizing Dye C, 2 g of 2-mercapto-5-methylbenzimidazole, 21.5 g of 4-chlorobenzophenone-2-carboxylic acid, 580 g of 2-butanone, and 220 g of dimethylformamide were added to the emulsion, which was allowed to stand for 3 hours. With stirring, there were further added 8 g of 5-tribromomethylsulfonyl-2-methylthiadiazole (II-2), 2 g of Disulfide Compound (1), 140 g of 1,1-bis(2-hydroxy-3,5-dimethylphenyl)-3,5,5-trimethylhexane, 5 g of tetrachlorophthalic acid, 2.1 g of Hydrazine Compound A, 1.1 g of Megafax F-176P (fluorinated surfactant by Dai-Nippon Ink & Chemicals K.K.), a dyestuff or pigment, the type and amount of which are shown in Table 8, 590 g of 2-butanone and 10 g of methyl isobutyl ketone.

Emulsion Surface Protective Layer Coating Solution

A coating solution was prepared by dissolving 75 g of CAB 171–15S (cellulose acetate butyrate by Eastman Chemical Products, Inc.), 5.7 g of 4-methylphthalic acid, 1.5 g of tetrachlorophthalic anhydride, 12 g of phthalazine, 0.3 g of Megafax F-176P, 2 g of Sildex H31 (true spherical silica having a mean size of 3 μm, by Dokai Chemical K.K.), and 5 g of Sumidur N3500 (polyisocyanate by Sumitomo-Bayern Urethane K.K.) in 3,070 g of 2-butanone and 30 g of ethyl acetate.

Preparation of Back Coated Support

A coating solution was prepared by adding 6 g of polyvinyl butyral (Denka Butyral #4000-2 by Denki Kagaku Kogyo K.K.), 0.2 g of Sildex H121 (true spherical silica having a mean size of 12 μm, by Dokai Chemical K.K.), 0.2 g of Sildex H51 (true spherical silica having a mean size of 5 μm, by Dokai Chemical K.K.), and 0.1 g of Megafax F-176P to 64 g of 2-propanol and stirring the mixture for dissolving the components. Further added to the solution were a solution containing 420 mg of Dyestuff (3) in 10 g of methanol and 20 g of acetone and a solution containing 1 g of 3-isocyanatomethyl-3,5,5-trimethylhexyl isocyanate in 7 g of ethyl acetate.

Onto a polyethylene terephthalate film having moisture-proof subbing layers of vinylidene chloride on opposite surfaces, the back layer coating solution was coated so as to provide an optical density of 0.7 at 633 nm.

The compounds used herein are of the structural formulae shown below, and Dyestuffs (1b) and (2) are the same as used in Example 5.

Sensitizing Dye C

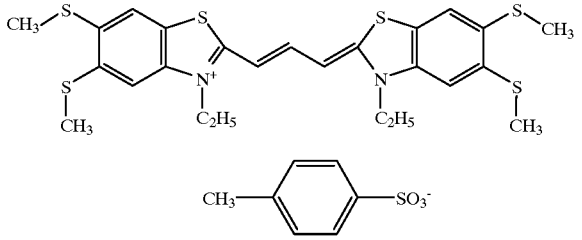

Disulfide Compound (1)

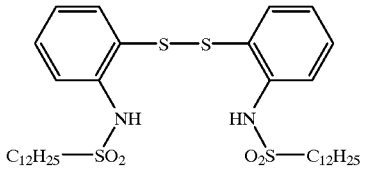

Hydrazine Compound A

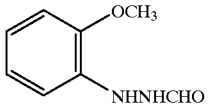

Dyestuff (3)

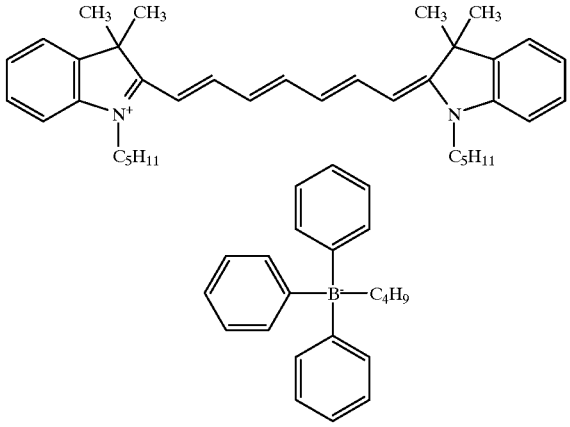

Preparation of Emulsion Layer-coated Sample

The emulsion layer coating solution was coated to the support prepared above so as to provide a silver coverage of 2 g/m$^2$. The emulsion surface protective layer coating solution was coated onto the emulsion layer to a dry thickness of 2 $\mu$m, obtaining Samples 8-1 to 8-9.

The thus obtained samples were examined as in Example 5, with the results shown in Table 8.

It is evident that outstanding effects are accomplished in this example and Samples 8-4 to 8-9 within the scope of the invention are fully stable against light illumination.

According to the invention, photothermographic recording elements which are satisfactory in image tone, free of discoloration or fading upon light illumination, and improved in tone stability during storage are available.

Example 9

An intermediate layer coating solution was prepared as follows.

Intermediate Layer Coating Solution

An intermediate layer coating solution was obtained by adding 10 g of hydroxypropyl methyl cellulose 60SH50 (Shin-Etsu Chemical K.K.), 0.8 g of 4-methylphthalic acid, 0.6 g of phthalazine and 0.04 g of Surfactant B used in Example 7 to 264 g of water.

In Samples 7-4 to 7-9 described in Example 7, an intermediate layer (binder amount 1.8 g/m$^2$) was formed between the emulsion coating layer and the protective layer by triple layer co-coating and drying. All the samples were found to achieve the benefits of the invention.

What is claimed is:

1. A photothermographic recording element comprising a transparent support, a binder, a non-photosensitive organic silver salt, a photosensitive silver halide, and a reducing agent, characterized in that at least one constituent layer on said transparent support is a photosensitive layer containing a photosensitive silver halide and a binder wherein at least one layer of the photosensitive layer comprises at least one component selected from the group consisting of (a) polymeric microparticulates containing a dyestuff selected from the group consisting of pyrazoloazole, anthraquinone, azo, azomethine, oxonol, carbocyanine, styryl, triphenylmethane, indoaniline, indophenol, and squarylium dyestuffs, (b) microcapsules containing said dyestuff, and (c) an organic or inorganic pigment selected from the group consisting of azo pigments, phthalocyanine pigments, indanthrone pigments, indigo pigments, guinacridone pigments and dioxazine pigments;

and wherein at least one of said constituent layers comprises a polyhalogenated compound of formula (I):

TABLE 8

| Sample No. | Dyestuff/pigment | coverage (mg/m$^2$) | D (λ max) (Fresh) | D (λ max) (Xe 1d) | Retentivity (%) | ΔFog (115° C./25 sec) |
|---|---|---|---|---|---|---|
| 8-1 (comparison) | none | — | — | — | — | 0.02 |
| 8-2 (comparison) | Dyestuff (1b) | 45 | 0.39 | 0.07 | 18 | 0.03 |
| 8-3 (comparison) | Dyestuff (2) | 45 | 0.32 | 0.14 | 44 | 0.02 |
| 8-4 (invention) | C. I. Pigment Blue 60 | 75 | 0.35 | 0.33 | 94 | 0.03 |
| 8-5 (invention) | C. I. Pigment Blue 64 | 75 | 0.30 | 0.27 | 90 | 0.03 |
| 8-6 (invention) | C. I. Pigment Blue 15:6 | 75 | 0.34 | 0.34 | 100 | 0.02 |
| 8-7 (invention) | C. I. Pigment Blue 16 | 75 | 0.38 | 0.37 | 97 | 0.02 |
| 8-8 (invention) | C. I. Pigment Violet 37 | 64 | 0.29 | 0.29 | 100 | 0.03 |
| 8-9 (invention) | C. I. Pigment Red 202 | 64 | 0.28 | 0.28 | 100 | 0.02 |

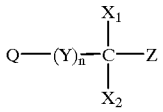

wherein, in formula (I), Q is an alkyl, aryl or heterocyclic group, each of $X_1$ and $X_2$ is a halogen atom, Z is a hydrogen atom or electron attractive group, Y is —C(=O)—, —SO— or —$SO_2$—, and n is equal to 0 or 1.

2. The photothermographic recording element of claim 1 wherein at least one of constituent layers comprises a toner.

3. The photothermographic recording element of claim 1 wherein (i) the polymeric microparticulates containing a dyestuff have at least one absorption peak in the range of 500 to 700 nm, (ii) the microcapsules containing a dyestuff have at least one absorption peak in the range of 500 to 700 nm, and (iii) the organic or inorganic pigment has at least one absorption peak in the range of 500 to 700 nm.

4. The photothermographic recording element of claim 1 wherein an aqueous polymer latex is used as the binder.

5. The photothermographic recording element of claim 1, wherein the dyestuff in the polymeric microparticulates or microcapsules is contained in an amount of 1 $\mu$g to 1 g per square meter of the element, and the pigment is contained in an amount of 1 mg to 3 g per square meter of the element.

6. The photothermographic recording element of claim 1, wherein the organic or inorganic pigment is contained in an emulsion from which said at least one layer is formed.

7. The photothermographic recording element of claim 1, wherein the electron attractive group represented by Z in formula (I) has a Hammett's substituent constant up $\sigma_p$ of at least 0.01.

8. The photothermographic recording element of claim 7, wherein Z in formula (I) is a bromine atom.

9. The photothermographic recording element of claim 1, wherein the polyhalogenated compound is contained in an amount of 10 mg to 3 g per square meter of the element.

* * * * *